US011952841B2

(12) United States Patent
Fox

(10) Patent No.: US 11,952,841 B2
(45) Date of Patent: Apr. 9, 2024

(54) TOOL STRING COMPOSITE TRANSMISSION ELEMENT

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 85 days.

(21) Appl. No.: 17/883,785

(22) Filed: Aug. 9, 2022

(65) Prior Publication Data

US 2023/0025599 A1 Jan. 26, 2023

(51) Int. Cl.
*E21B 17/02* (2006.01)

(52) U.S. Cl.
CPC ..... *E21B 17/0283* (2020.05)

(58) Field of Classification Search
None
See application file for complete search history.

(56) References Cited

U.S. PATENT DOCUMENTS 6,670,880 B1 * 12/2003 Hall ..... E21B 17/028 336/15
6,717,501 B2 * 4/2004 Hall ..... E21B 47/13 336/15
7,053,788 B2 * 5/2006 Hall ..... E21B 47/13 340/854.3
7,116,199 B2 * 10/2006 Hall ..... H01R 13/533 336/90
8,826,972 B2 * 9/2014 Flint ..... E21B 17/0285 166/250.11
11,814,955 B2 * 11/2023 Fox ..... H04L 67/34
2004/0164838 A1 * 8/2004 Hall ..... E21B 17/0285 336/234
2006/0158296 A1 * 7/2006 Hall ..... F16L 25/01 336/130
2007/0023185 A1 * 2/2007 Hall ..... E21B 17/028 166/65.1
2008/0251247 A1 * 10/2008 Flint ..... E21B 17/0283 166/380
2022/0170327 A1 * 6/2022 Fox ..... E21B 47/13
2022/0235615 A1 * 7/2022 Fox ..... E21B 47/13
2022/0367110 A1 * 11/2022 Fox ..... H01F 27/38
2023/0031858 A1 * 2/2023 Fox ..... E21B 17/028
2023/0184101 A1 * 6/2023 Fox ..... E21B 47/13 340/854.4

* cited by examiner

*Primary Examiner* — Carlos Garcia

(57) ABSTRACT

A tool string composite transmission element comprising a composite polymeric carrier comprising an electrical conductor embedded therein. The conductor may be connected to ground and to a cable and may be suitable for producing an electromagnetic field within the carrier when energized. The conductor may comprise a tab that may align with a slot within the carrier to prevent rotation of individual carrier fragments or segments strung along the conductor. The carrier may comprise a volume of MCEI particles sufficient to allow the carrier to transmit the electromagnet field to an adjacent carrier. The transmitted field may be used to convey data and power. The carrier may comprise an annular or linear configuration. Also, the carrier may comprise a bumper for securing the carrier within a groove within a tool within the tool string. The carrier may comprise a depression in its outer top surface above the electrical conductor.

19 Claims, 28 Drawing Sheets s (Prior Art) FIG. 8

(Prior Art) FIG. 9

(Prior Art) FIG. 10

(Prior Art) FIG. 11

(Prior Art) FIG. 12

(Prior Art) FIG. 13

(Prior Art) FIG. 14

(Prior Art) FIG. 15

(Prior Art) FIG. 16

(Prior Art) FIG. 17

(Prior Art) FIG. 18

(Prior Art) FIG. 19

(Prior Art) FIG. 20

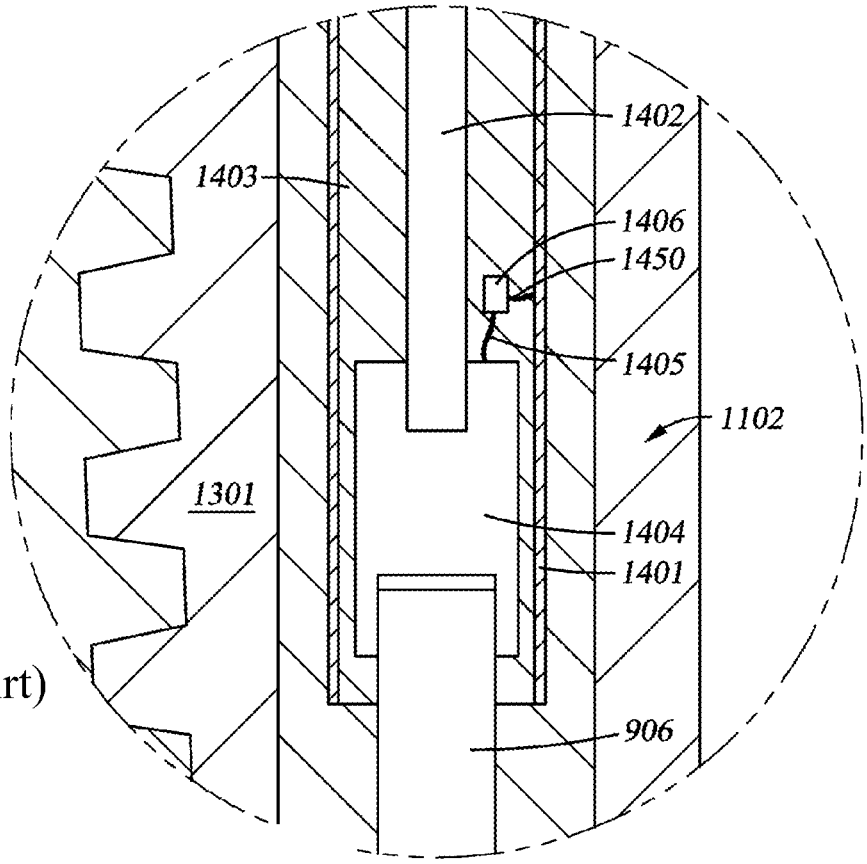
(Prior Art)
FIG. 21
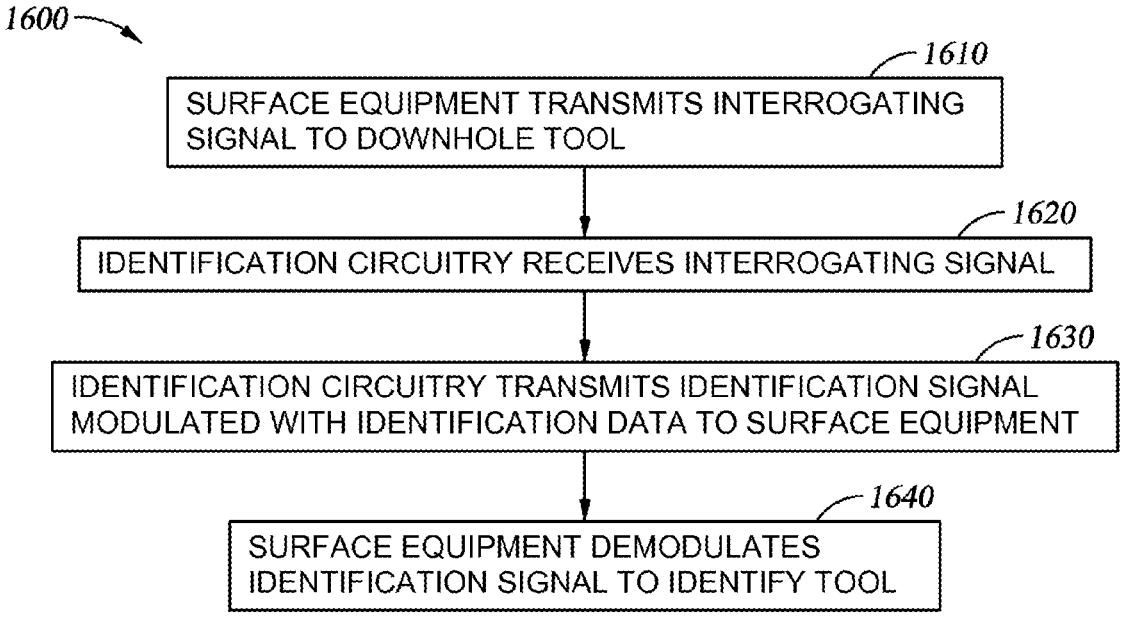
(Prior Art) FIG. 22

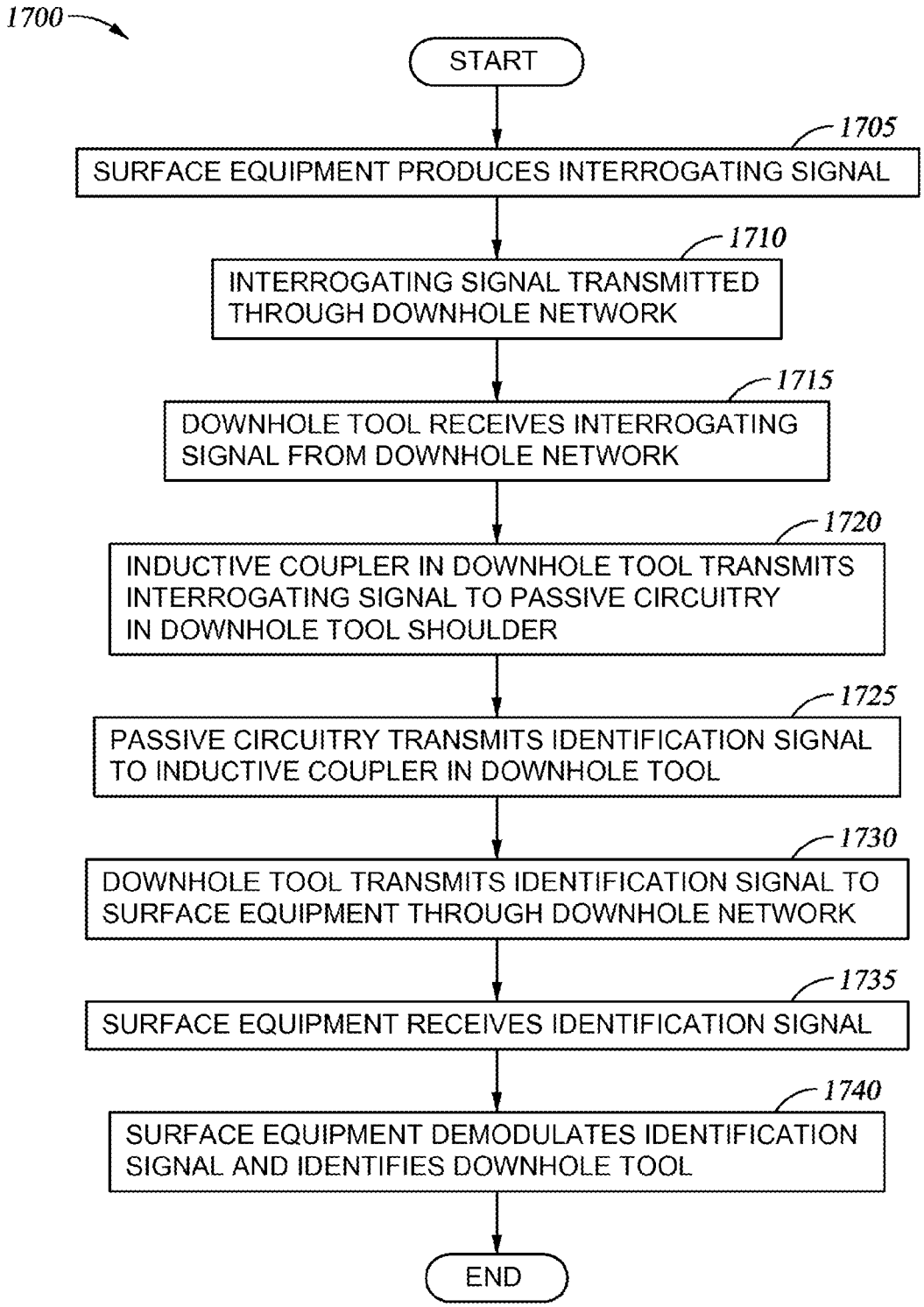
(Prior Art) FIG. 23

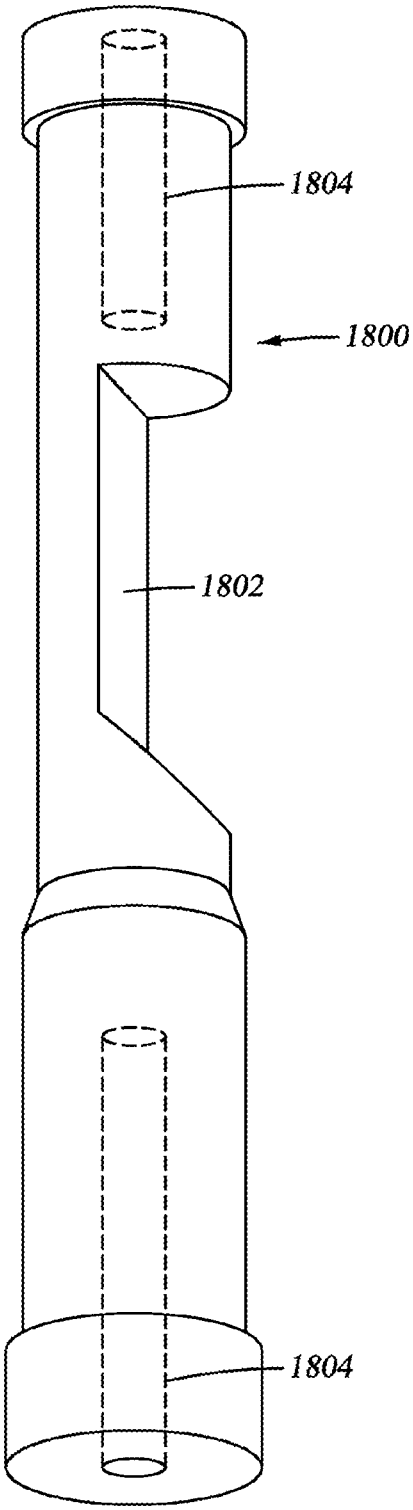
(Prior Art) FIG. 24
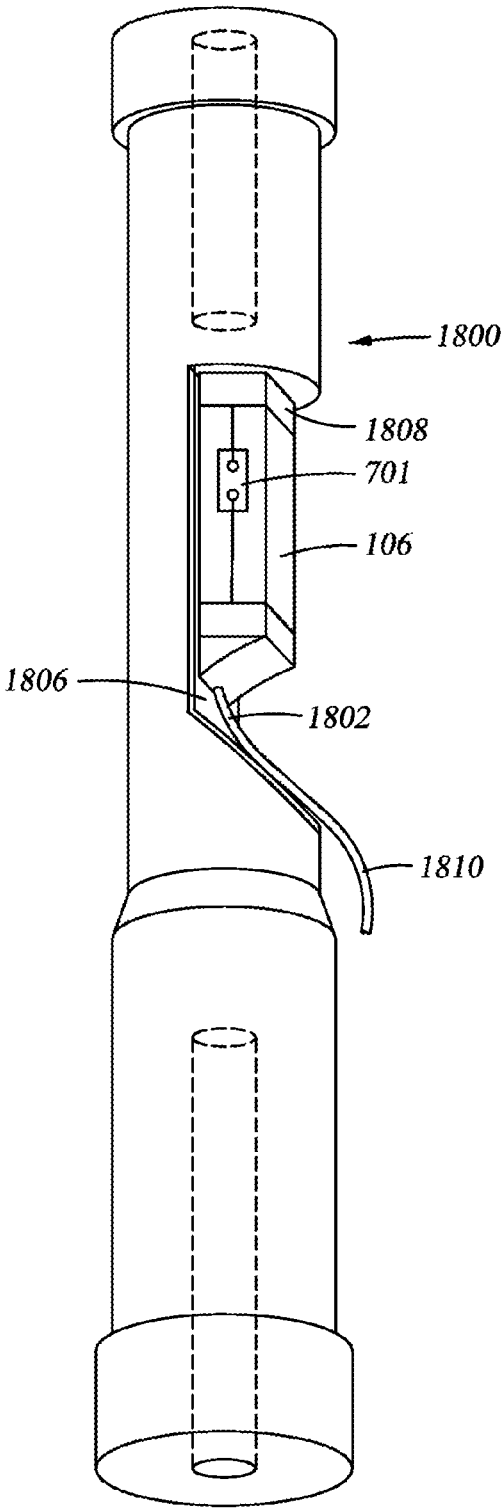
(Prior Art) FIG. 25

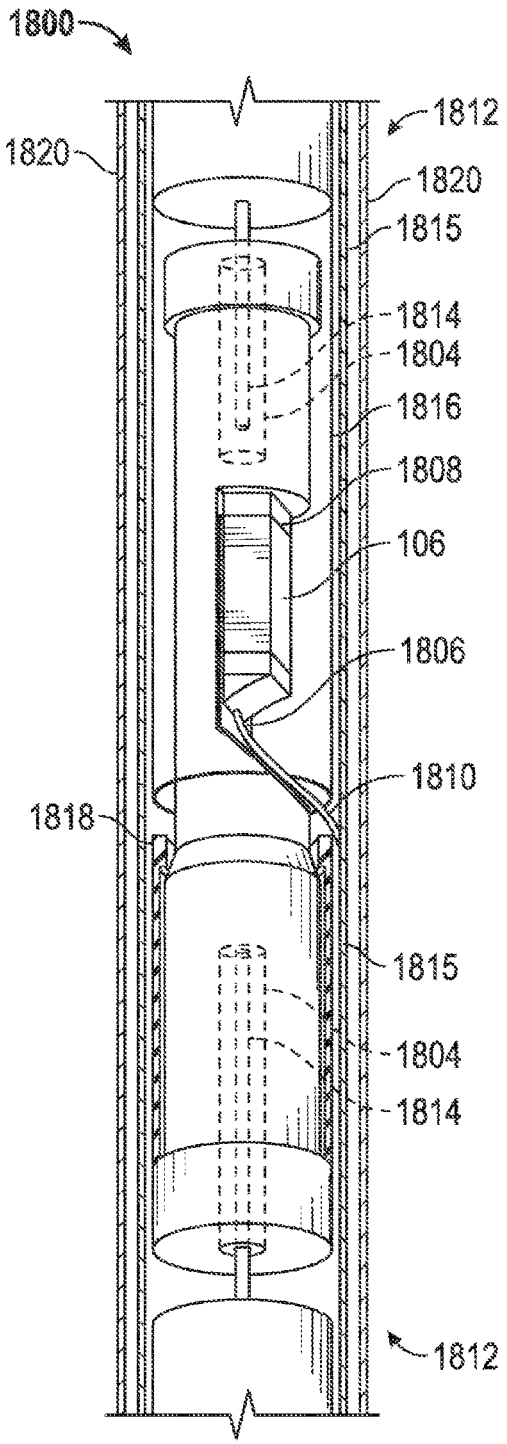
(Prior Art) FIG. 26
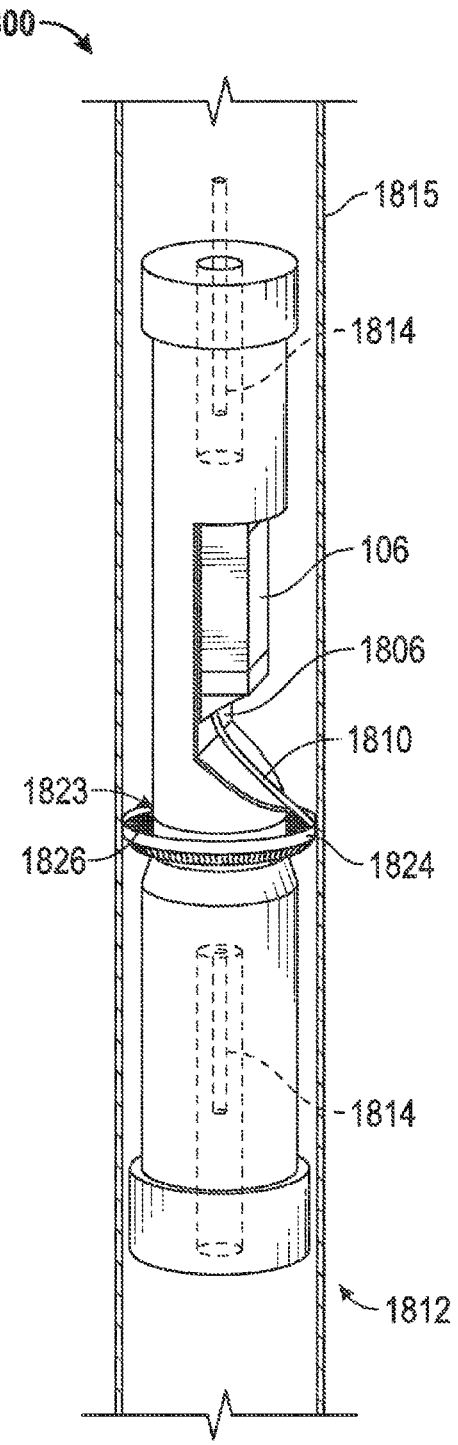
(Prior Art) FIG. 27

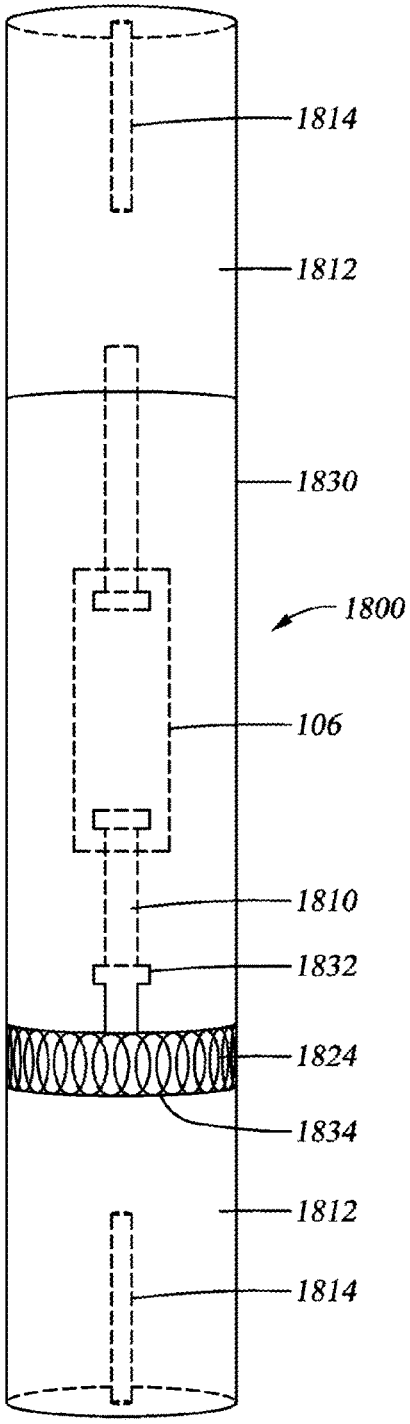
(Prior Art) FIG. 28
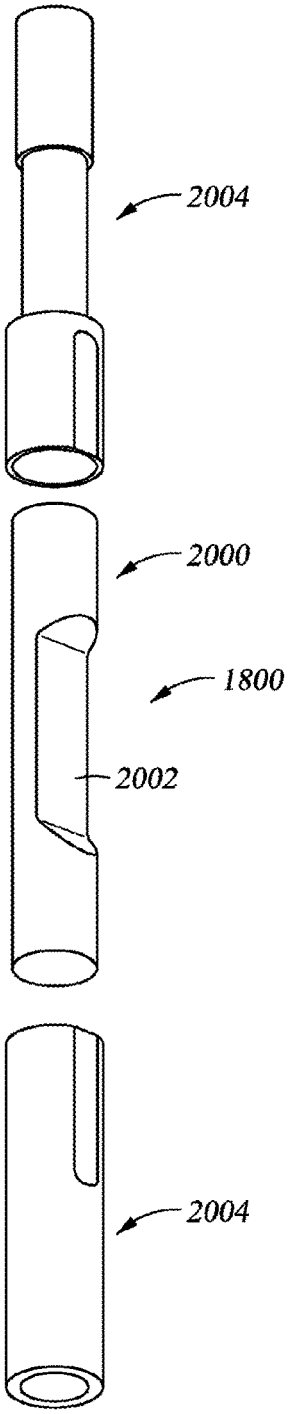
(Prior Art) FIG. 29
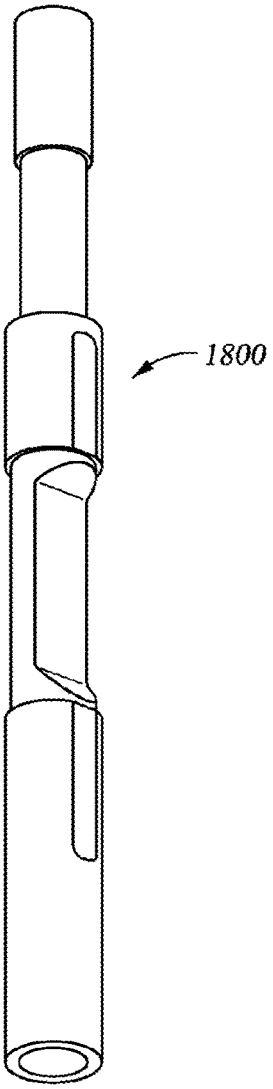
(Prior Art) FIG. 30

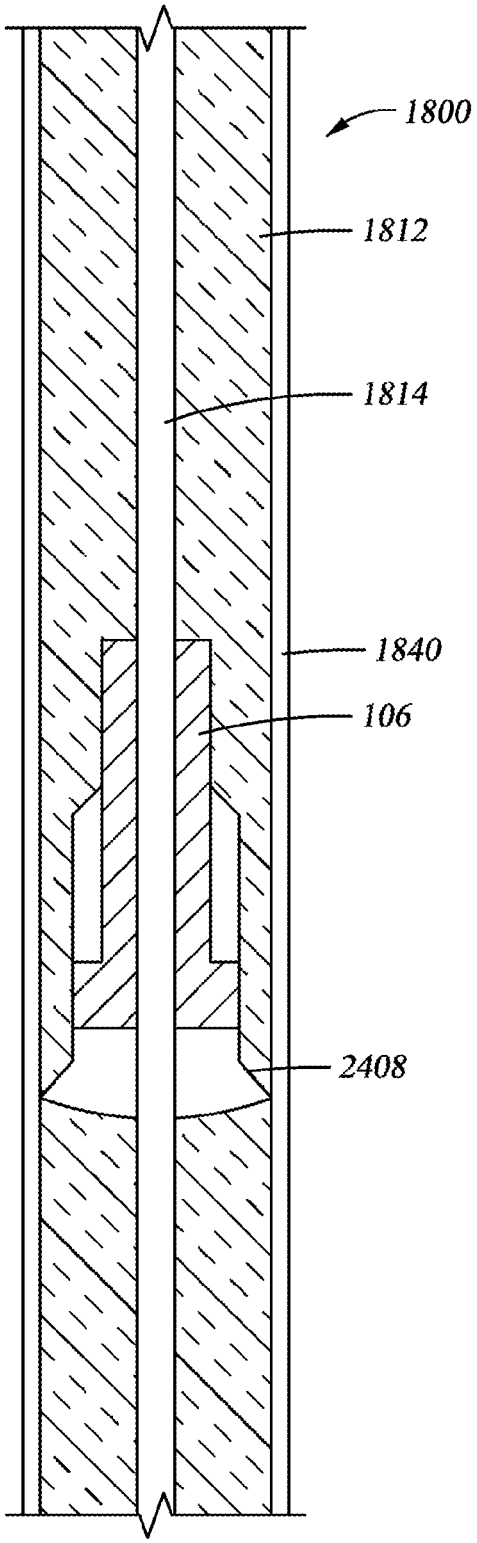
(Prior Art) FIG. 31
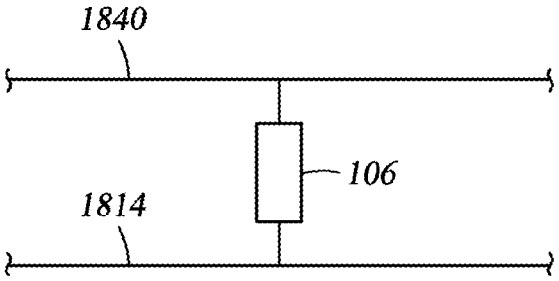
(Prior Art) FIG. 32A
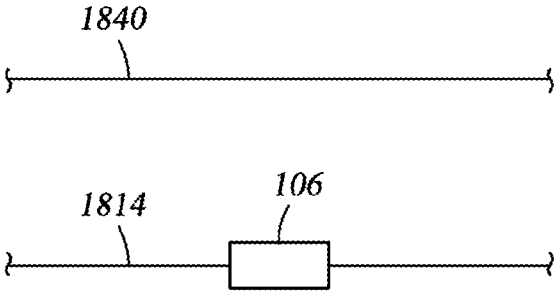
(Prior Art) FIG. 32B

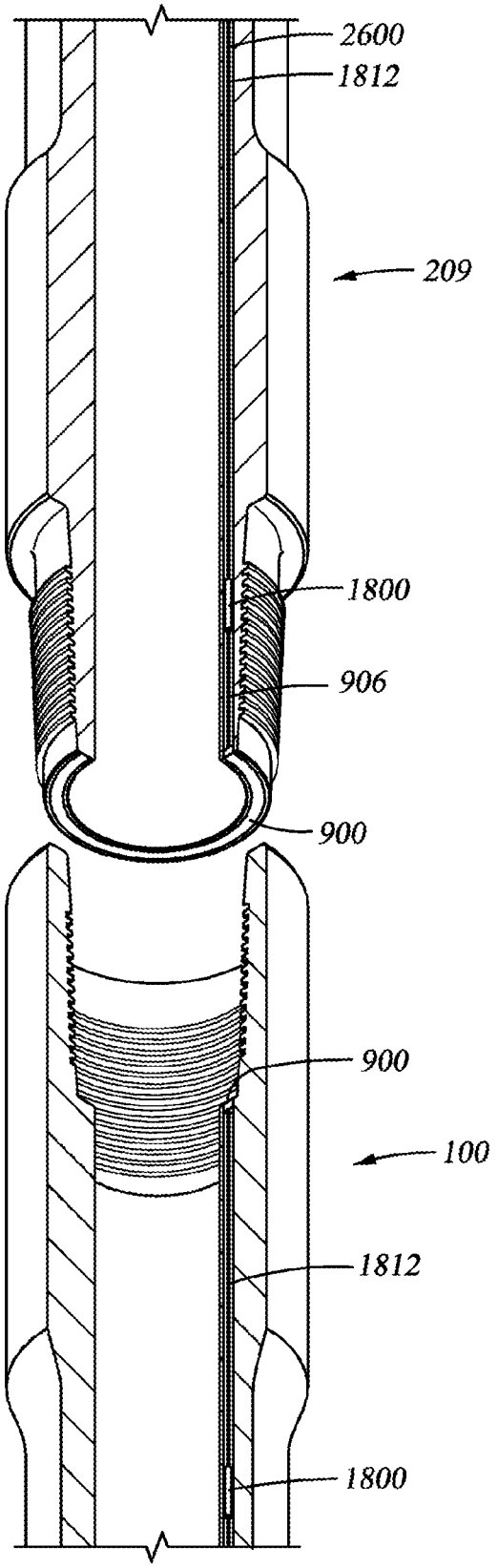
(Prior Art) FIG. 33

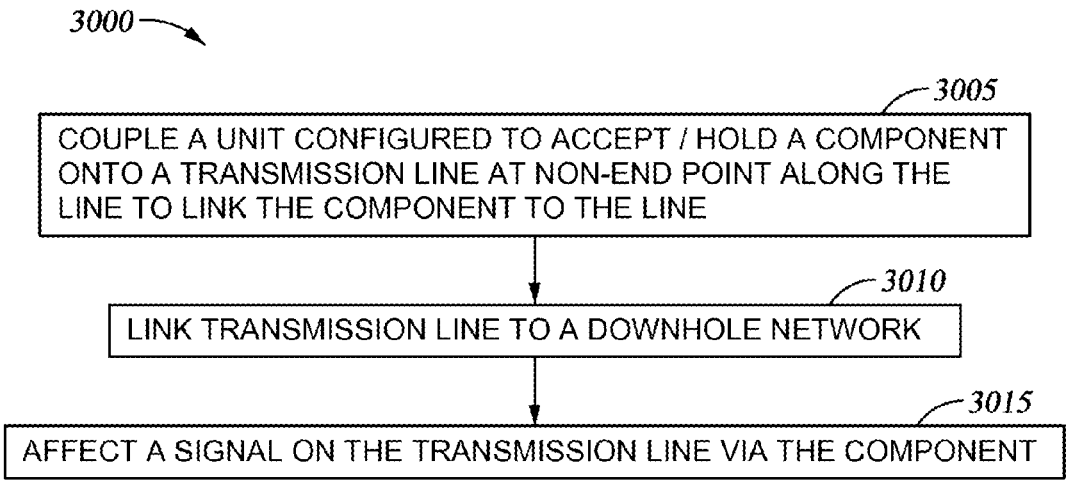
(Prior Art) FIG. 34
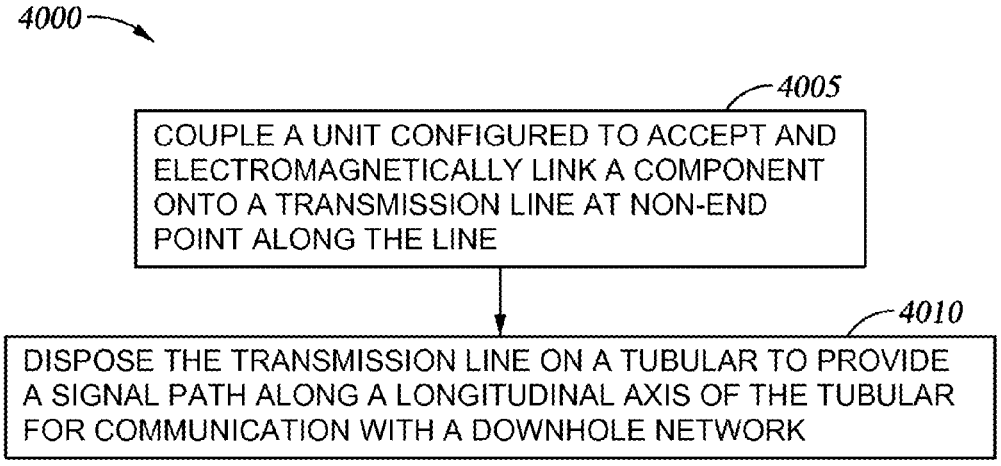
(Prior Art) FIG. 35

TOOL STRING COMPOSITE TRANSMISSION ELEMENT

BACKGROUND

1. Technical Field

This invention relates generally to the field of signal conveyance and, more particularly, to techniques for signal manipulation on transmission lines.

2. Description of Related Art

This application presents a modification and alteration of U.S. Pat. No. 8,826,972, to Flint et al., entitled Platform for Electrically Coupling a Component to a Downhole Transmission Line, issued Sep. 9, 2014, incorporated herein by this reference.

U.S. patent application Ser. No. 17/559,619, to Fox, entitled Inductive Coupler for Downhole Transmission Line, filed Dec. 22, 2021, is incorporated herein by this reference.

U.S. patent application Ser. No. 17/665,533, to Fox, entitled Downhole Transmission System with perforated MCEI Segments, filed Feb. 5, 2022, is incorporated herein by this reference.

Due to high costs associated with drilling for hydrocarbons and extracting them from underground formations, efficiency in drilling operations is desirable to keep overall expenses down. Electronic equipment may be useful in drilling operations to accomplish many tasks, such as providing identification information about specific downhole components to surface equipment, performing downhole measurements, collecting downhole data, actuating tools, and other tasks.

Notwithstanding its utility in the drilling process, downhole has proven to be a rather hostile environment for electronic equipment. Temperatures downhole may reach excesses of 200.degree. C. Shock and vibration along a tool string may knock circuitry out of place or damage it. A drilling mud with a high pH is often circulated through a tool string and returned to the surface. The drilling mud and other downhole fluids may also have a detrimental effect on electronic equipment downhole exposed to it.

In the art, a first group of attempts to protect downhole electronics comprises an apparatus with electronic circuitry in a sonde that is lowered into a borehole by a cable periodically throughout the drilling process. The sonde provides protection from downhole conditions to the electronic circuitry placed inside. Examples of this type of protection (among others) may be found in U.S. Pat. No. 3,973,131 to Malone, et al. and U.S. Pat. No. 2,991,364 to Goodman, which are herein incorporated by reference.

A second group comprises adapting downhole tools to accommodate and protect the electronic circuitry. In this manner the electronic circuitry may remain downhole during drilling operations. For example, U.S. Pat. No. 6,759,968 discloses the placement of an RFID device in an O-ring that fills a gap in a joint of two ends of pipe or well-casing. U.S. Pat. No. 4,884,071 to Howard discloses a downhole tool with Hall Effect coupling circuitry located between an outer sleeve and an inner sleeve that form a sealed cavity.

A need remains for improved signal communication, generation, conveyance, and manipulation techniques, particularly in drilling operations.

SUMMARY

The following summary description is related to FIGS. 1-7 of the present application. The teachings of the '972 also apply to said FIGS. except when modified by the said FIGS.

The present application discloses a tool string such as one used in drilling oil and gas wells as well as geothermal wells fitted for high speed data communication and power transmission through a composite transmission element or inductive coupler. The composite transmission element, or inductive coupler, may comprise a composite polymeric carrier comprising an electrical conductor embedded therein. The electrical conductor may be suitable for producing an electromagnetic field or flux within the carrier when energized by an electric signal. The carrier may be formed by plastic injection molding, rotational molding, injection molding, extrusion molding, reaction injection molding, injection blow molding, vacuum casting, thermoforming, or compression molding, or a combination of such methods.

The composite polymeric carrier may comprise an enhanced magnetically conductive electrically insulating, MCEI, polymer. The polymer may be suitable for use under extreme conditions of moisture, heat, and vibration, such as may be found downhole. The enhanced MCEI polymer may comprise a volume of MCEI particles in sufficient quantity to allow the polymeric carrier to transmit the electromagnet field to an adjacent carrier. The adjacent carrier may comprise a design different from the polymeric carrier. For example, a carrier taught herein at (Prior Art) FIGS. 16-19 may be suitable for coupling with polymeric carrier.

The polymeric carrier may comprise an annular configuration comprising an annular conductor. The actual configuration may depend on any particular application in the tool string. Also, the polymeric carrier may comprise a linear configuration comprising a linear conductor.

The electrical conductor may be a wire or multiple wires. It may also be a strip or a helical coil. The electrical conductor may comprise an anti-rotation tab. The tab may be continuous along the periphery of the conductor or it may be periodic at selected locations along the conductor. The anti-rotation tab may be formed in the electrical conductor by drawing the conductor through a form die or by hammering, pinching, pressing, or other means at the time the conductor is manufactured. The tab may be formed in the conductor post manufacturing. The polymeric carrier may comprise an anti-rotation slot that mates with the anti-rotation tab.

The MCEI enhanced polymer may comprise a volume of MCEI particles of around between 65 and 84 percent by volume of the polymeric carrier. It may be desirable that the carrier comprise an enhanced polymer comprising a volume of MCEI particles of around between 85 and 90 percent by volume of the polymeric carrier. Or, the MCEI enhanced polymer may comprise a volume of MCEI particles of around up to 97 percent by volume of the polymer carrier.

The transmission element may comprise a polymeric carrier that exhibits in cross section an arcuate outer wall joining a planar top surface and an electrical conductor disposed below the top surface. On the other hand, the polymeric carrier may exhibit in cross section an arcuate outer wall joining a partially planar top surface and an electrical conductor disposed below the top surface, wherein the partially planar top surface is interrupted by a depression disposed above the electrical conductor. The bifurcated planar top surface may aid in the transmission of data and power across aligned transmission elements.

The electrical conductor may comprise a ground end attachable to a tool body and a transmission end attachable to a cable within the tool body. The cable may run along the tool to connect the electrical conductor to a similarly configured transmission element within the tool body or tool string.

The polymeric carrier may be disposed within a groove within the tool body, such as an annular groove in the shoulder of a drill pipe. The polymeric carrier may comprise a bumper. The bumper may be aligned with a bumper seat in the groove in the tool body. The seated bumper may aid in fixing the polymeric carrier within tool string. The polymeric carrier may comprise a void proximate the bumper. The void may provide resilience in the carrier and bumper to aid in the installation and retention of the carrier in the groove.

The polymeric carrier may comprise a U-shape open channel, in cross section, comprising an inner wall and an outer wall. The electrical conductor may be laid within the open channel. The open channel may be filled with a nonconducting polymeric filler.

The polymeric carrier may comprise one or more perforations proximate the ends. The perforations may provide an exit for the respective ends from the carrier. The perforations may allow additional connections with the electrical conductor.

It may be desirable that the groove comprises a region harder than the surrounding tool body. The harder region may be provided by an insert surrounding the groove. The region surrounding the groove may be made harder than the tool body by peening, including shot and laser peening, brinelling, or plating. The region surrounding the groove may be selectively heat treated to increase the hardness of the region. The walls of the groove, itself, may also be harder than the surrounding tool body.

The tool string composite transmission element may comprise a polymeric carrier comprising a plurality of fragments or segments. The segments may comprise a division of the annular configuration. The polymeric carrier may comprise between 20 and 353 individual fragments or segments strung together on the electrical conductor to form the annular configuration.

The following portion of the summary is taken from the '972 reference and applies to FIGS. 1-7 except when modified by said FIGS.

One aspect of the invention provides a component platform for a transmission line. The platform includes a unit configured to accept and hold a component. The unit is configured to couple onto a transmission line at a non-end point along the line to link the component to the line. The transmission line is configured to link to a downhole network. The component is configured to affect a signal on the transmission line.

One aspect of the invention provides a component platform for a transmission line. The platform includes a unit configured to accept and hold a component. The unit is configured to couple onto a transmission line, at a non-end point along the line, to link the component to the line. The transmission line is configured for disposal on a tubular configured to link to a downhole network to provide a signal path along a longitudinal axis of the tubular. The component is configured to affect a signal on the transmission line.

One aspect of the invention provides a component platform for a transmission line. The platform includes a unit configured to accept and hold a component. The unit is configured to couple onto a transmission line, at a non-end point along the line, to link the component to the line. The transmission line is configured for disposal on a tubular to provide a signal path along a longitudinal axis of the tubular for communication with a downhole network.

One aspect of the invention provides a method for linking a component to a transmission line. The method includes coupling a unit onto a transmission line at a non-end point along the line, the unit configured to accept and hold a component, to link the component to the line; linking the transmission line to a downhole network; and affecting a signal on the transmission line via the component.

One aspect of the invention provides a method for linking a component to a transmission line. The method includes coupling a unit onto a transmission line at a non-end point along the line, the unit configured to accept and electromagnetically link a component to the line; and disposing the transmission line on a tubular to provide a signal path along a longitudinal axis of the tubular for communication with a downhole network.

It should be understood that for the purposes of this specification the term "integrated circuit" refers to a plurality of electronic components and their connections produced in or on a small piece of material. Examples of integrated circuits include (but are not limited to) circuits produced on semiconductor substrates, printed circuit boards, circuits produced on paper or paper-like substrates, and the like. Similarly, for the purpose of this specification the term "component" refers to a device encompassing circuitry and/or elements (e.g., capacitors, diodes, resistors, inductors, integrated circuits, etc.) typically used in conventional electronics applications.

It should also be understood that for the purposes of this specification the term "protected" refers to a state of being substantially secure from and able to function in spite of potential adverse operating conditions.

BRIEF DESCRIPTION OF THE DRAWINGS

Other aspects and advantages of the invention will become apparent upon reading the following detailed description and upon reference to the drawings in which like elements have been given like numerals and wherein:

(PRIOR ART)

(PRIOR ART)

(PRIOR ART)

(PRIOR ART)

(PRIOR ART)

(PRIOR ART)

(PRIOR ART)

(PRIOR ART)

(PRIOR ART)

(PRIOR ART)

(PRIOR ART)

(PRIOR ART)

(PRIOR ART) FIG. 21 is a detailed view of (PRIOR ART) FIG. 20.

(PRIOR ART) FIG. 22 is a flowchart illustrating a method for identifying a tool in a downhole tool string.

(PRIOR ART) FIG. 23 is a flowchart illustrating a more detailed method for identifying a tool in a downhole tool string.

(PRIOR ART) FIG. 24 is a schematic of a component platform consistent with the present invention.

(PRIOR ART) FIG. 25 is a schematic of a component disposed on a component platform consistent with the present invention.

(PRIOR ART) FIG. 26 is a schematic of a component platform linked to a transmission line consistent with the present invention.

(PRIOR ART) FIG. 27 is a schematic of another component platform linked to a transmission line consistent with the present invention.

(PRIOR ART) FIG. 28 is a schematic of another component platform consistent with the present invention.

(PRIOR ART) FIG. 29 is a schematic of a multi-piece component platform consistent with the present invention.

(PRIOR ART) FIG. 30 is a schematic of the component platform assembly of (PRIOR ART) FIG. 29.

(PRIOR ART) FIG. 31 is a cut-away side view of a clip-on component platform consistent with the present invention.

(PRIOR ART) FIG. 32 depicts circuit topologies applicable to the component platforms consistent with the present invention.

(PRIOR ART) FIG. 33 is a perspective view of a pair of tubulars implemented with component platforms consistent with the present invention.

(PRIOR ART) FIG. 34 is a flowchart illustrating a method for linking a component to a transmission line consistent with the present invention.

(PRIOR ART) FIG. 35 is a flowchart illustrating another method for linking a component to a transmission line consistent with the present invention.

DETAILED DESCRIPTION

Figure 1:
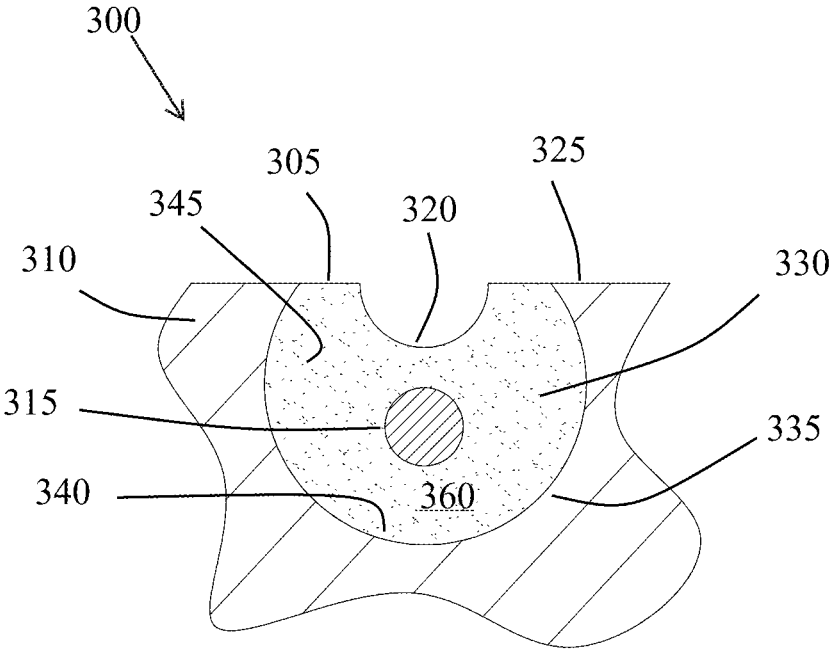
FIG. 1 is a sectioned diagram of a polymeric carrier of the present invention.
Figure 2:
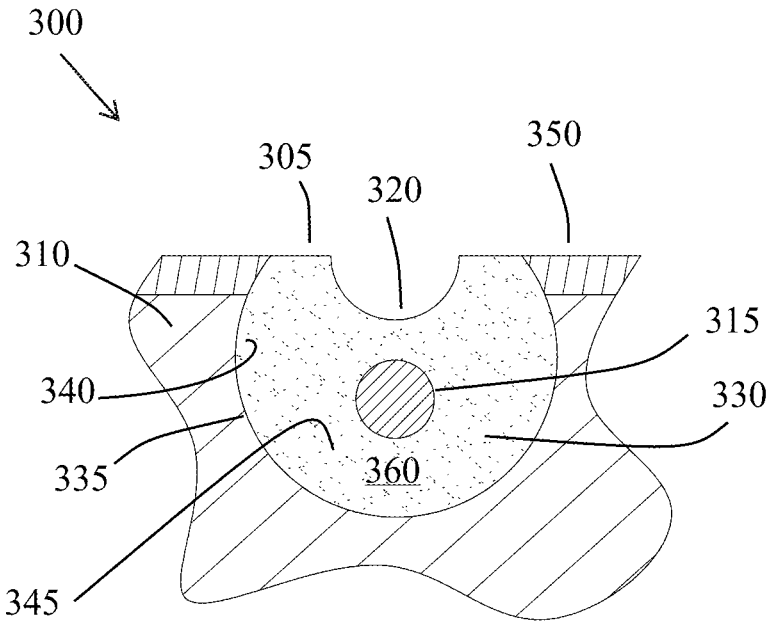
FIG. 2 is a sectioned diagram of an iteration of the polymeric carrier of the present invention.
Figure 3:
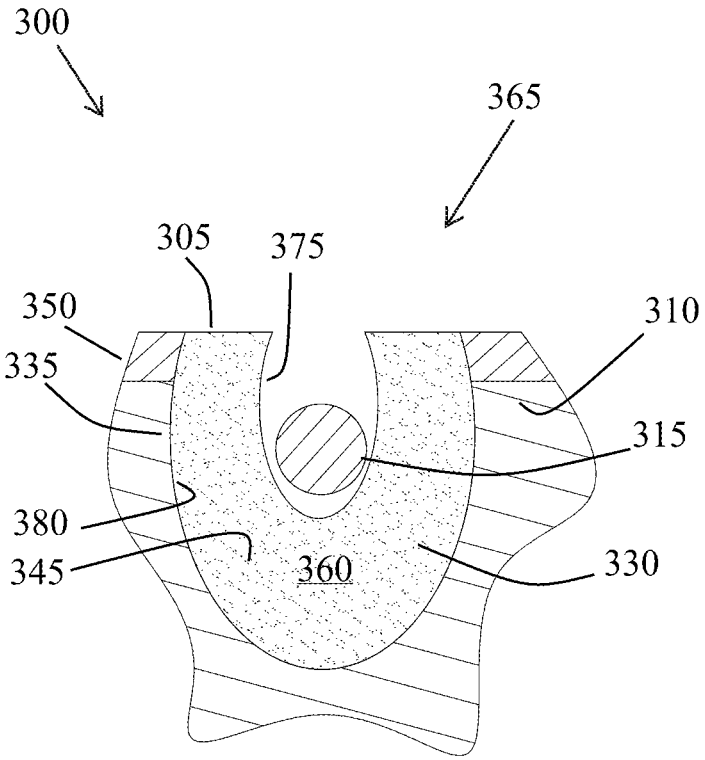
FIG. 3 is a sectioned diagram of an iteration of the polymeric carrier of the present invention.
Figure 4:
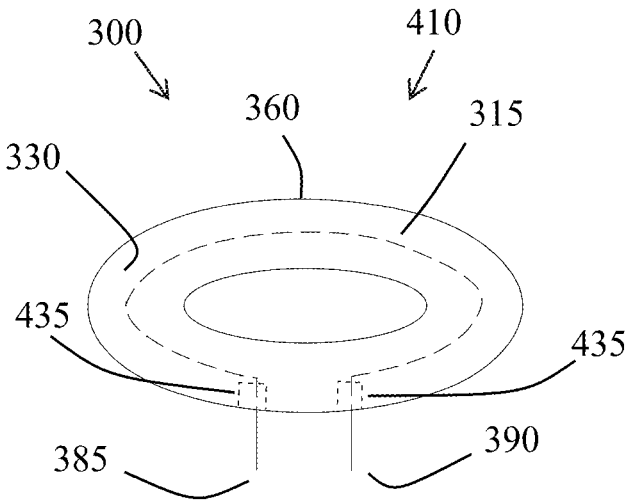
FIG. 4 is a perspective diagram of an annular polymeric carrier of the present invention.
Figure 5:
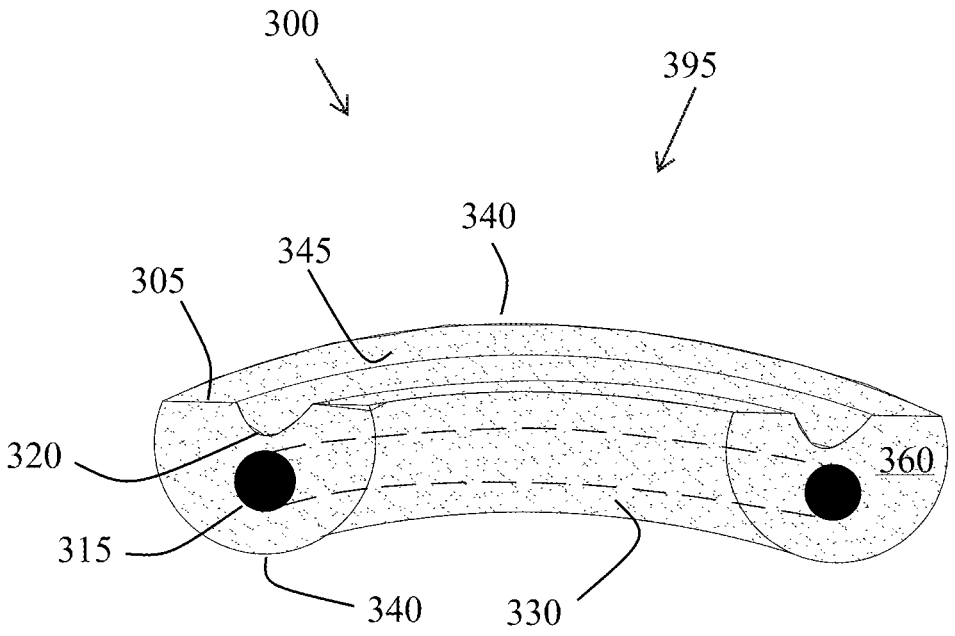
FIG. 5 is a perspective diagram of an annular segment of the polymeric carrier of the present invention.
Figure 6:
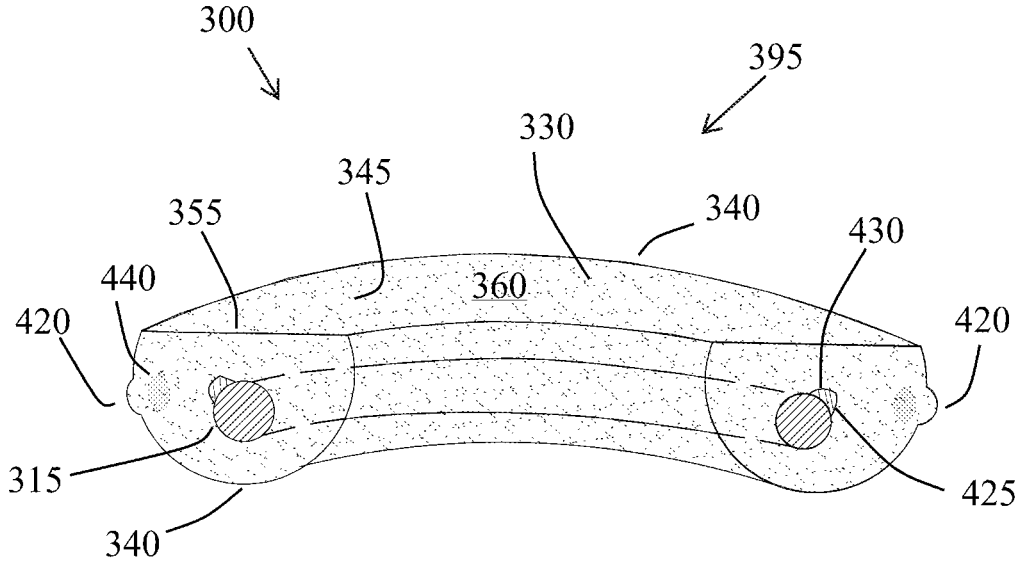
FIG. 6 is a perspective diagram of an annular segment of the polymeric carrier of the present invention.
Figure 7:
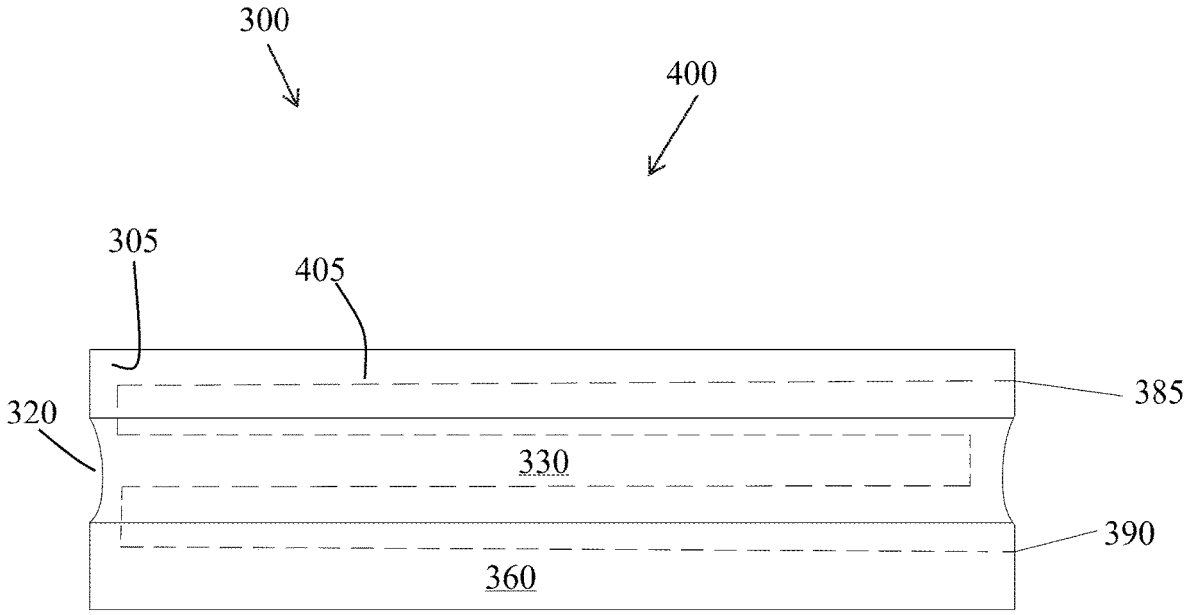
FIG. 7 is a diagram of a plan view of an iteration of the polymeric carrier of the present invention.

The following detailed description is related to FIGS. 1-7 of the present application. The teachings of the '972 also apply to said FIGS. except when modified by the said FIGS.

The present application discloses a tool string such as one used in drilling oil and gas wells as well as geothermal wells fitted for high speed data communication and power transmission through an inductive coupler or composite transmission element 300. The composite transmission element 300 may comprise a composite polymeric carrier 360 comprising an electrical conductor 315 embedded therein. The electrical conductor 315 may be suitable for producing an electromagnetic field or flux within the carrier 360 when energized by an electric signal. The carrier 360 may be formed by plastic injection molding, rotational molding, injection molding, extrusion molding, reaction injection molding, injection blow molding, vacuum casting, thermoforming, or compression molding, or a combination of such methods.

The composite polymeric carrier 360 may comprise an enhanced magnetically conductive electrically insulating, MCEI, polymer 330. The polymer may be suitable for extreme conditions of heat, pressure, and vibration. The polymer may be resistant to chemical contamination. The enhanced MCEI polymer 300 may comprise a volume of MCEI particles 345 in sufficient quantity to allow the polymeric carrier 360 to transmit the electromagnet field to an adjacent carrier 360. The adjacent carrier may comprise a design different from the polymeric carrier 360. For example, a carrier taught herein at (Prior Art) FIGS. 16-19 may be suitable for coupling with polymeric carrier 360.

The polymeric carrier 360 may comprise an annular configuration 395/410 comprising an annular conductor 315. The actual configuration may depend on any particular application in the tool string. Also, the polymeric carrier 360 may comprise a linear configuration 400 comprising a linear conductor 405.

The electrical conductor 315/405 may be a wire or multiple wires. It may also be a strip or a helical coil. The electrical conductor 315/405 may comprise an anti-rotation tab 425. The tab 425 may be continuous along the periphery of the conductor or it may be periodic at selected locations along the conductor. The anti-rotation tab 425 may be formed in the electrical conductor 315/405 by drawing the conductor through a form die or by hammering, pinching, pressing, or other means at the time the conductor is manufactured. The tab 425 may be formed in the conductor post manufacturing. The polymeric carrier 360/405 may comprise an anti-rotation slot 430 that mates with the anti-rotation tab 425.

The MCEI enhanced polymer 330 may comprise a volume of MCEI particles 345 of around between 65 and 84 percent by volume of the polymeric carrier 360. It may be desirable that the carrier 360 comprise an enhanced polymer 330 comprising a volume of MCEI particles 345 of around between 85 and 90 percent by volume of the polymeric carrier 360. Or, the MCEI enhanced polymer 330 may comprise a volume of MCEI particles 345 of around up to 97 percent by volume of the polymer carrier 360.

The transmission element 300 may comprise a polymeric carrier 360 that exhibits in cross section an arcuate outer wall 340 joining a planar top surface 355 and an electrical conductor 315 disposed below the top surface 355. On the other hand, the polymeric carrier 360 may exhibit in cross section an arcuate outer wall 340 joining a partially planar top surface 305 and an electrical conductor 315 disposed below the top surface 305, wherein the partially planar top surface 305 is interrupted by a depression 320 disposed above the electrical conductor 315. The bifurcated planar top surface 305 may aid in the transmission of data and power across aligned transmission elements.

The electrical conductor 315 may comprise a ground end 385 attachable to a tool body 310 and a transmission end 390 attachable to a cable within the tool body 310. The cable may run along the tool to connect the electrical conductor 315 to a similarly configured transmission element within the tool body or tool string.

The polymeric carrier may be disposed within a groove 335 within the tool body 310, such as an annular groove in the shoulder of a drill pipe. The polymeric carrier 360 may comprise a bumper 420. The bumper 420 may be aligned with a bumper seat in the groove 335 in the tool body. The seated bumper 420 may aid in fixing the polymeric carrier within tool string. The polymeric carrier 360 may comprises a void 440 proximate the bumper 420. The void 440 may provide resilience in the carrier 360 and bumper 420 to aid in the installation and retention of the carrier 360 in the groove 335.

The polymeric carrier 360 may comprises a U-shape 365 open channel 370, in cross section 365, comprising an inner wall 375 and an outer wall 380. The electrical conductor 315 may be laid within the open channel 370. The open channel 370 may be filled with a nonconducting polymeric filler.

The polymeric carrier 360 may comprise one or more perforations 435 proximate the ends 385/390. The perforations 435 may provide an exit for the respective ends 385/390 from the carrier 360. The perforations 435 may allow additional connections with the electrical conductor 315.

It may be desirable that the groove 335 comprises a region 350 harder than the surrounding tool body 310. The harder region may be provided by an insert 350 surrounding the groove 335. The region surrounding the groove 335 may be made harder than the tool body 310 by peening, including shot and laser peening, brinelling, or plating. The region surrounding the groove 335 may be selectively heat treated to increase the hardness of the region. The walls of the groove 335, itself, may also be harder than the surrounding tool body 310.

The tool string composite transmission element 300 may comprise a polymeric carrier 360 comprises a plurality of fragments or segments. The segments may comprise a division of the annular configuration 395/410. The polymeric carrier 360 may comprise between 20 and 353 individual fragments or segments strung together on the electrical conductor 315 to form the annular configuration 395/410.

The following portion of the detailed description is taken from the '972 reference and applies to FIGS. 1-7 except as modified by this disclosure.

Figure 8:
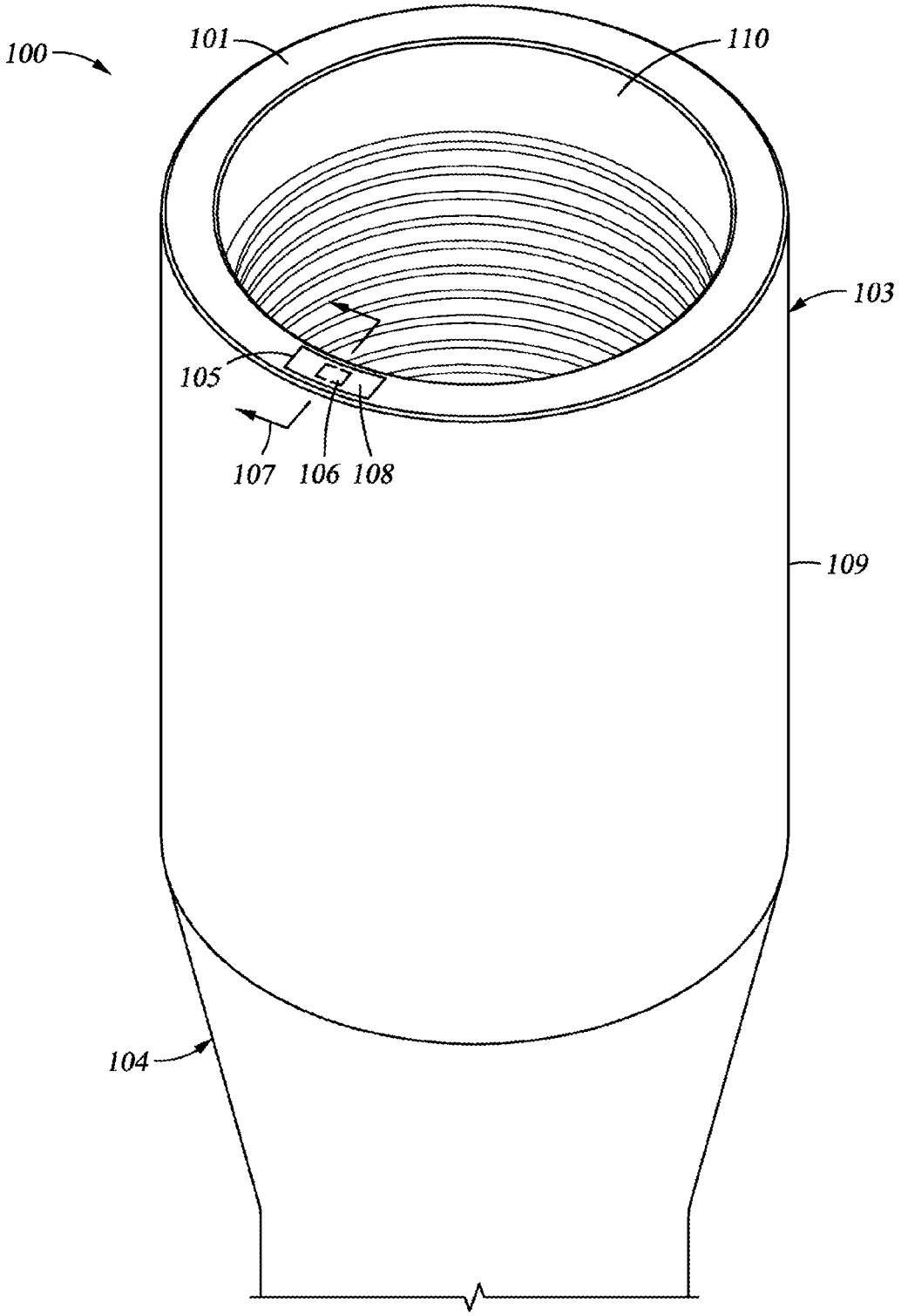
FIG. 8 is a perspective view of a box end of a downhole tool with an integrated circuit in a primary mating surface (PRIOR ART)

Referring to (PRIOR ART) FIG. 8, a portion of a downhole tool 100 according to the present invention is shown. The downhole tool 100 comprises a tubular body 104 that may allow the passage of drilling fluids under pressure through the downhole tool 100. The tubular body 100 has a threaded box end 103, an exterior wall 109 and a bore 110. The box end 103 may be designed to couple to a pin end 203 of another downhole tool 209 see (PRIOR ART) FIG. 9. The threaded box end 103 may be adapted to create a secure joint between two downhole tools 100, 209 see (PRIOR ART) FIG. 13.

The box end 103 of the downhole tool 100 comprises a primary mating surface 101, which in the shown embodiment is a primary shoulder. The primary mating surface 101 is intermediate the exterior wall 109 and the bore 110. The primary mating surface 101 is adapted to couple to a primary mating surface 201 in a second downhole tool 209 see (PRIOR ART) FIG. 13. The primary mating surface 101 comprises a recess 105 in which a component 106 (e.g., an integrated circuit) is disposed. In the embodiment shown, the recess 105 is somewhat rectangular with dimensions proportionate to the physical dimensions of the component 106. In other embodiments, the recess 105 may be an annular groove or have a shape disproportionate to the dimensions of the component 106.

In one aspect of the invention, the component 106 may include a radio frequency identification (RFID) circuit. Preferably, the component 106 is a passive device powered by a received electromagnetic signal. In other words, an interrogation signal received by the component 106 may provide the energy necessary to power the component 106 circuitry. This particular characteristic may be desirable as it may eliminate the need of providing and periodically replacing a power supply for each integrated circuit in a component.

A component 106 comprising RFID circuitry may be desirable for various applications—for instance, the circuitry may store identification information such as a serial number that it may provide to an RFID query device (e.g., a hand-held wand, a fixed RFID interrogator, etc.) upon receiving an interrogating signal.

The component 106 may be encapsulated in a protective material 108. The protective material 108 may conform to the dimensions of the recess 105. The protective material 108 may be a permanent potting material such as a hard epoxy material. In other embodiments, the protective material 108 may be a less permanent potting material such as rubber, foam, and the like. The protective material 108 may guard the component 106 from downhole fluids such as drilling mud and oil. When the threaded box end 103 of the downhole tool 100 in this embodiment is coupled to the threaded pin end 203 of another downhole tool 209 see (PRIOR ART) FIG. 13 in a tool string, the primary mating surface 101 may substantially contact the primary mating surface 201 of the pin end 203 and form an effective mechanical seal, thus providing additional protection to the component 106 from the downhole environment. View 107 is a cross-sectional view of the component 106 and the recess 105 and is depicted in (PRIOR ART) FIG. 12.

Figure 9:
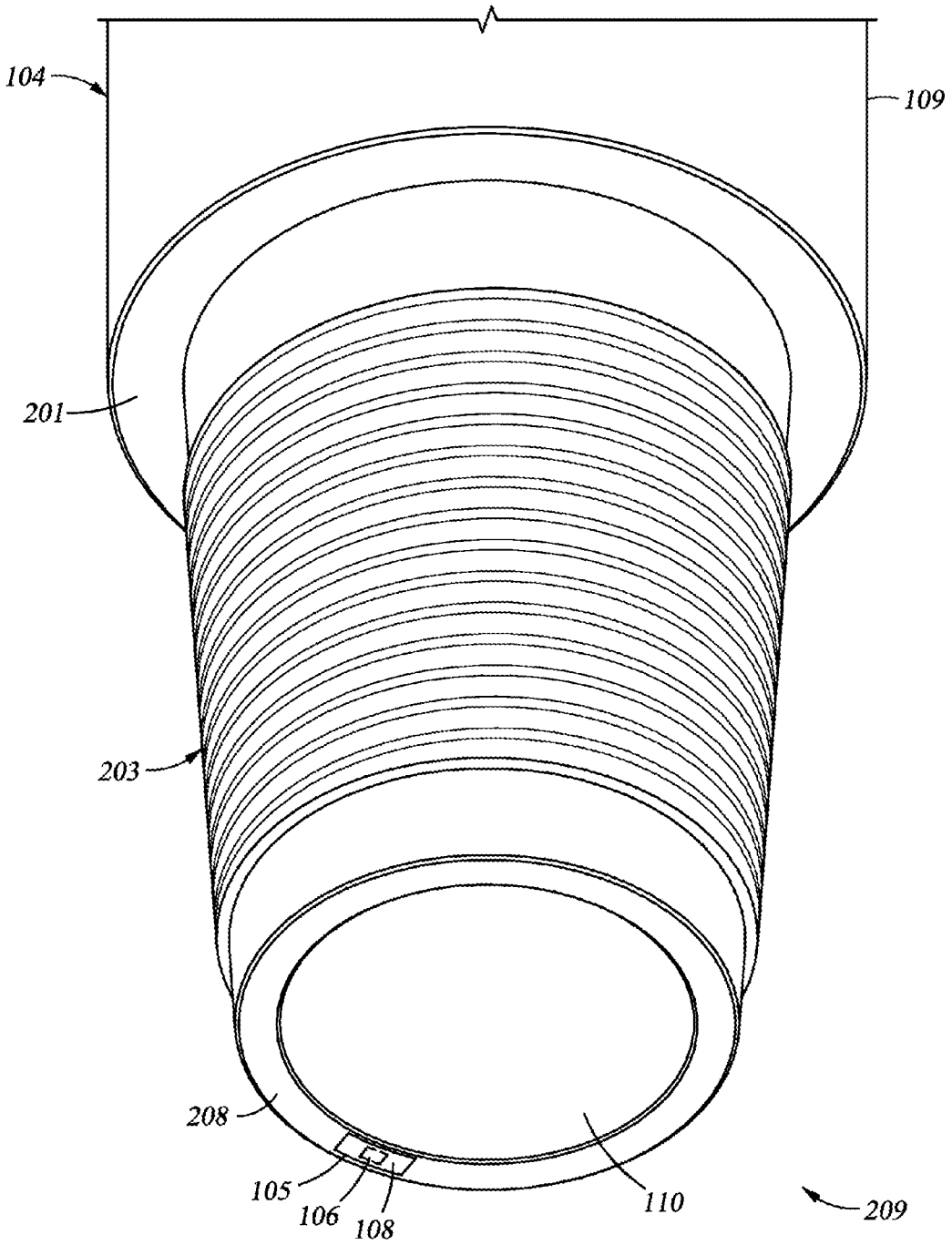
FIG. 9 is a perspective view of a pin end of a downhole tool with an integrated circuit in a secondary mating surface.

Referring now to (PRIOR ART) FIG. 9, a downhole tool 209 with a component 106 is shown. In this embodiment, the downhole tool 209 comprises a threaded pin end 203. The threaded pin end 203 may comprise a primary mating surface 201 and a secondary mating surface 208, both mating surfaces 201, 208 being intermediate the exterior wall 109 and the bore 110. The component 106 may be disposed within a recess 105 in the secondary mating surface 208. The pin end 203 may be designed to couple to the box end 103 of a separate downhole tool 100 through mating threads 202. When this occurs, the secondary mating surface 208 of the pin end 203 may make contact with a secondary mating surface 601 depicted in (PRIOR ART) FIG. 13 of the box end 103 and form an effective mechanical seal, providing additional protection to the component 106.

Figure 10:
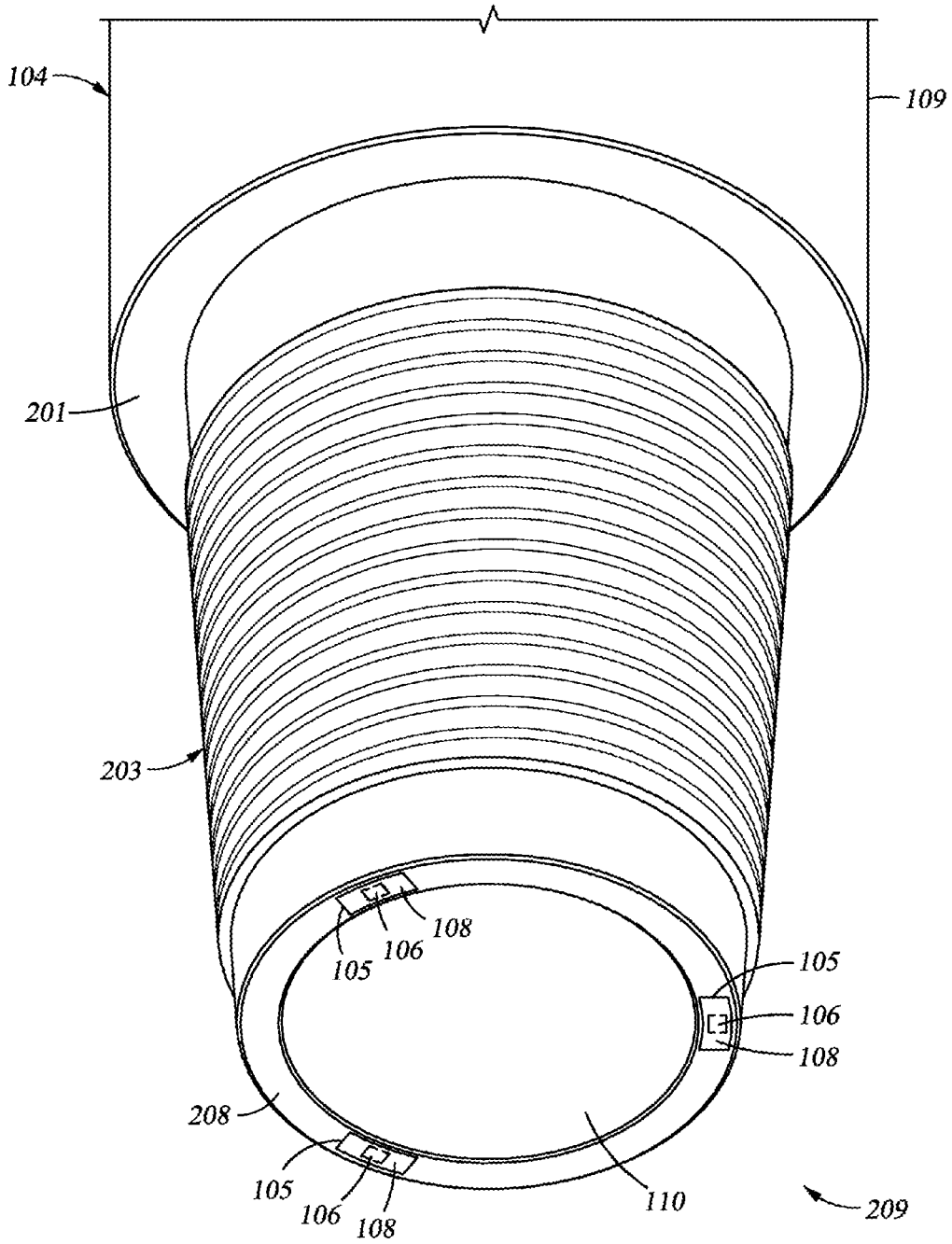
FIG. 10 is a perspective view of a pin end of a downhole tool with a plurality of integrated circuits in a secondary mating surface.

Referring now to (PRIOR ART) FIG. 10, it may be beneficial to have a plurality of components 106 in a downhole tool. For example, if the components 106 are passive RFID devices, they may emit an identification signal modulated with identification data such as a serial number to a receiver. However, due to their passive nature, a plurality of RFID devices configured to emit similar responses may provide a signal that is more easily detected by a receiver than that provided by a single RFID device. A plurality of recesses 105 may be circumferentially distributed along the secondary mating surface 208 to hold the plurality of components 106. In this manner, reception by a short-range RFID receiver may be facilitated for a rotating tool string in which a single component 106 is constantly varying its position with respect to a fixed surface receiver.

Figure 11:
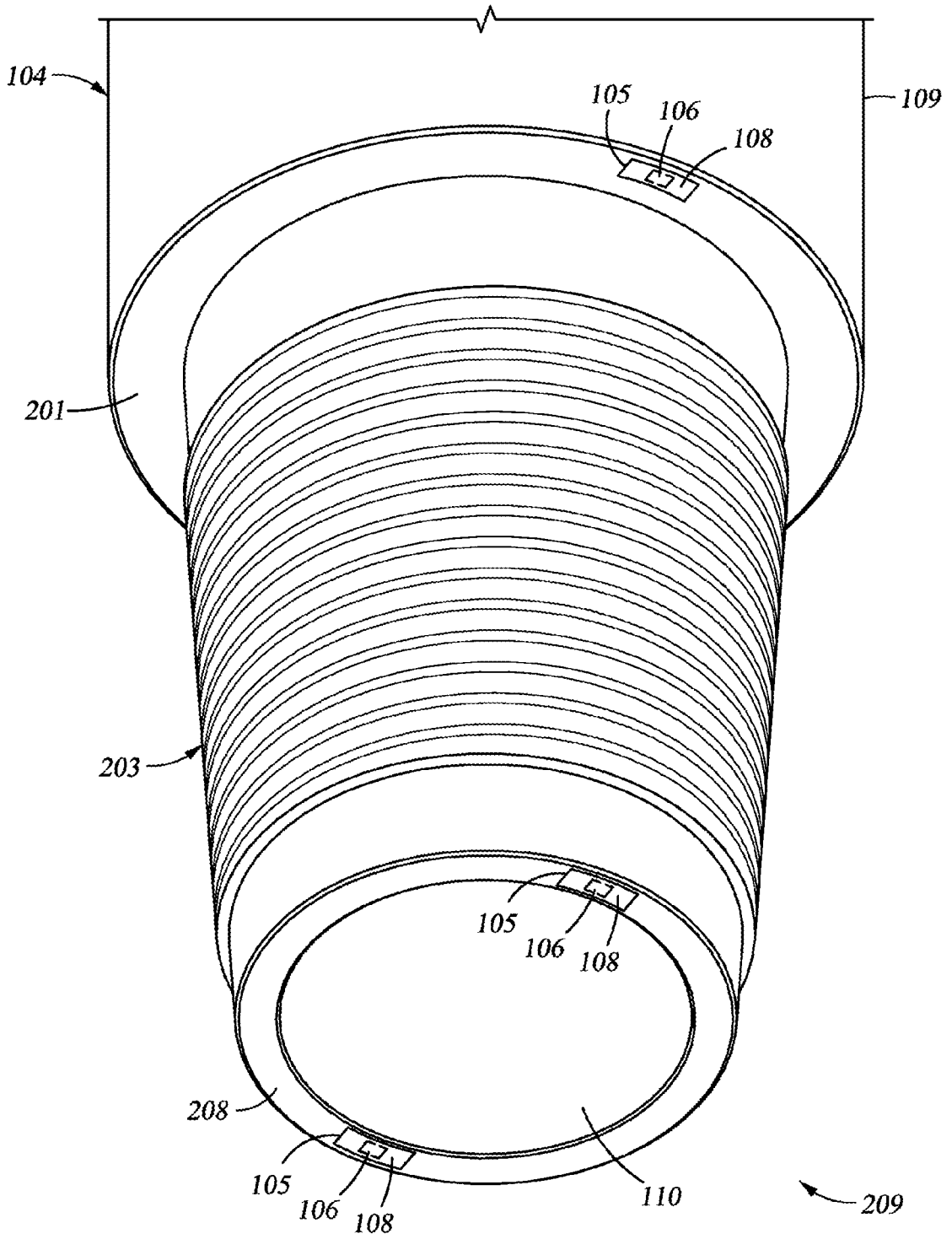
FIG. 11 is a perspective view of a pin end of a downhole tool with integrated circuits in both a primary and a secondary mating surface.

Referring now to (PRIOR ART) FIG. 11, a downhole tool 209 may comprise recesses 105 in both the primary mating surface 201 and the secondary mating surface 208. The recesses 105 may comprise components 106 with various specific applications. Due to the physical characteristics of the components 106 and/or nature of these applications, it may be more advantageous for a component 106 to be located at a specific spot in the downhole tool 209 than in other locations. For instance, a component 106 may be large enough that the recess 105 in which it is disposed affects the structural characteristics of the downhole tool. In cases where several such components 106 are used in the downhole tool 209, it may be beneficial to distribute the components 106 between the primary mating surface 201 and the secondary mating surface 208 in order to minimize the effect on the structural characteristics in the downhole tool 209.

Figure 12:
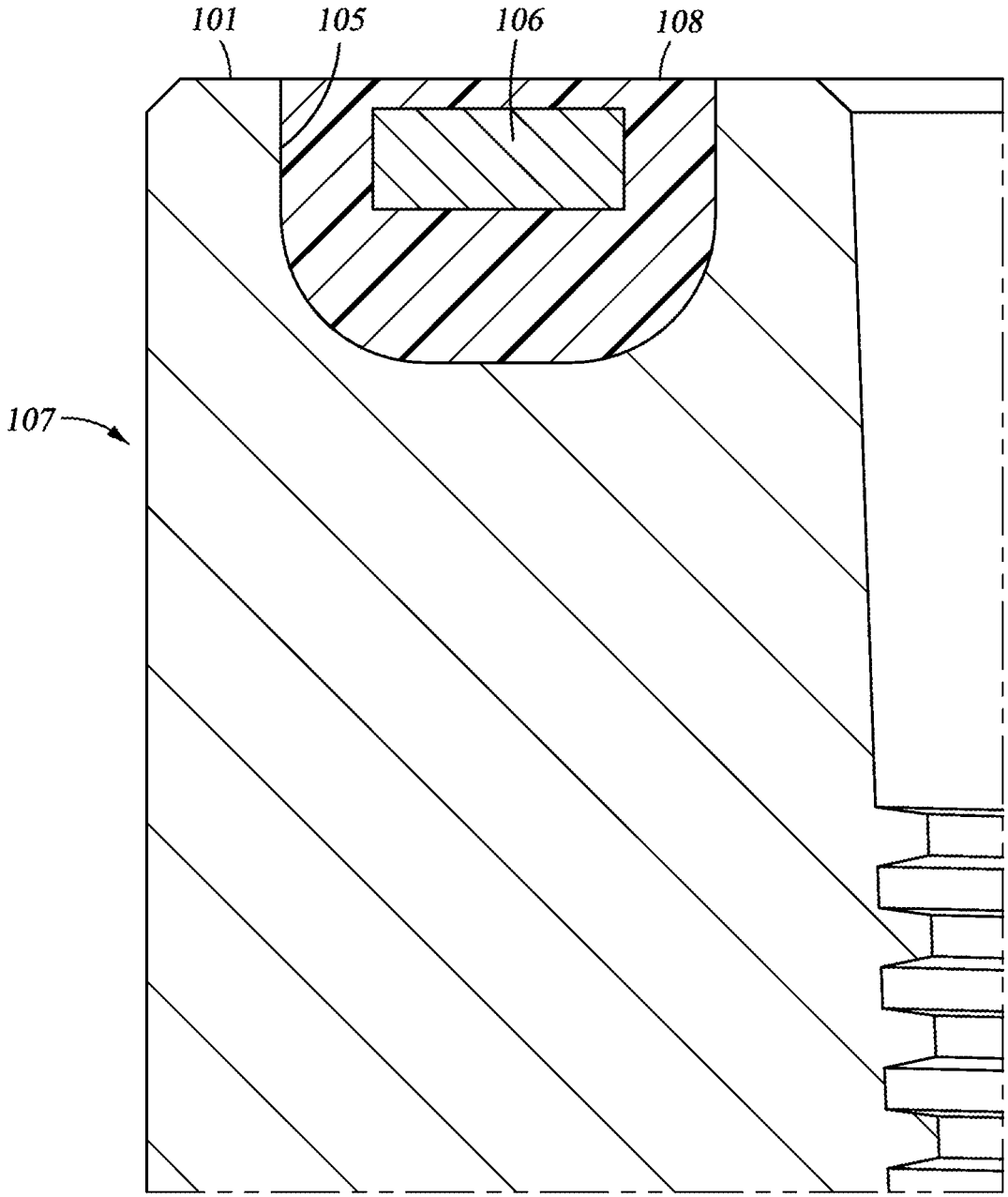
FIG. 12 is a cross-sectional view along line 107 of (PRIOR ART) FIG. 8.

(PRIOR ART) FIG. 12 is a cross-sectional view 107 of the component 106 disposed within the recess 105 of the shoulder 101 shown in (PRIOR ART) FIG. 8. In this particular embodiment, the component 106 is encapsulated in a protective material 108. The protective material 108 may serve a variety of purposes. For example, the protective material 108 may form a chemical bond with the material of the recess 105 and the component 106, serving to fix the component 106 in its position relative to the recess 105. The protective material 108 may also serve as a protection against drilling mud and other downhole fluids such as oil and/or water that may have an adverse effect on the component 106.

In the embodiment shown, the protective material 108 conforms to the dimensions of the recess 105 in order to provide additional structural security in the downhole tool 100 and protection from shocks and jolts to the component 106. The protective material 108 may comprise any of a variety of materials including (but not limited to) epoxies, synthetic plastics, glues, clays, rubbers, foams, potting compounds, Teflon®, PEEK® and similar compounds, ceramics, and the like. For embodiments in which the component 106 comprises RFID circuitry and other applications, the protective material 108 may be magnetically conductive in order to facilitate the transmission of electromagnetic communication to and from the component 106. In some embodiments, it may also be desirable for the protective material 108 to be electrically insulating and/or high-temperature resistant.

The protective material 108 may permanently encapsulate the component 106. Alternatively, the component 106 may be pre-coated with a material such as silicon, an RTV (room temperature vulcanizing) rubber agent, a non-permanent conformal coating material, or other material before encapsulation by the protective material 108 to facilitate its extraction from the protective material 108 at a later time.

Figure 13:
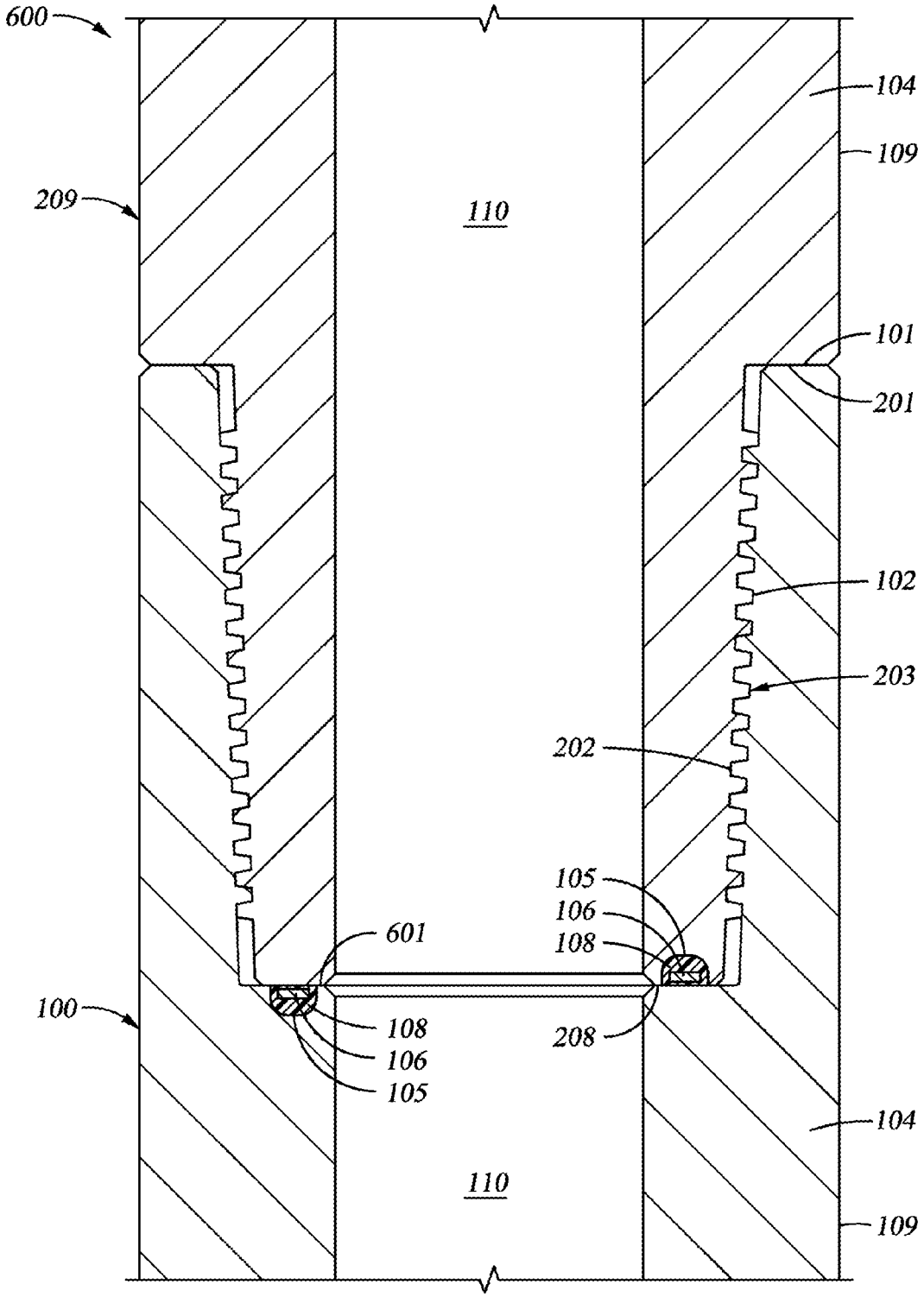
FIG. 13 is a cross-sectional view of a tool joint.

Referring now to (PRIOR ART) FIG. 13, a cross-sectional view of a tool joint 600 comprising the junction of a first downhole tool 100 comprising a threaded box end 103 and a second downhole tool 209 comprising a threaded pin end 203 is shown. The first downhole tool 100 may be joined to the second downhole tool 209 through mated threads 102, 202. The tool joint 600 may comprise the primary mating surface 101 and the secondary mating surface 601 of the first tool 100 being in respective mechanical contact with the primary mating surface 201 and the secondary mating surface 208 of the second tool 209, respectively. Specifically, the contact between secondary mating surfaces 601, 208 may provide a mechanical seal that protects one or more components 106 disposed in recesses 105 therein from fluids, debris and other adverse environmental conditions. The protective material 108 encapsulating the components 106 may be substantially flush with the surface of the secondary mating surface 601, 208 in which they are disposed to create an optimal sealing surface on the secondary mating surfaces 601, 208.

In some embodiments of the invention, measures may be taken to relieve pressure in the recess 105 if drilling mud, lubricants, and other downhole fluids become trapped within the recess 105 as the tool joint 600 is being made up. This high pressure may damage the component 106 or displace it from the recess 105. One means of relieving downhole pressure in the recess 105 is disclosed in U.S. Pat. No. 7,093,654 (assigned to the present assignee and incorporated by reference herein for all that it discloses). The means described in the '654 patent comprises a pressure equalization passageway that permits fluids under pressure in the mating threads 202, 102 of the tool joint 600 to flow between interior and exterior regions of tubular bodies 104 of the downhole tools 100, 209.

Figure 14:
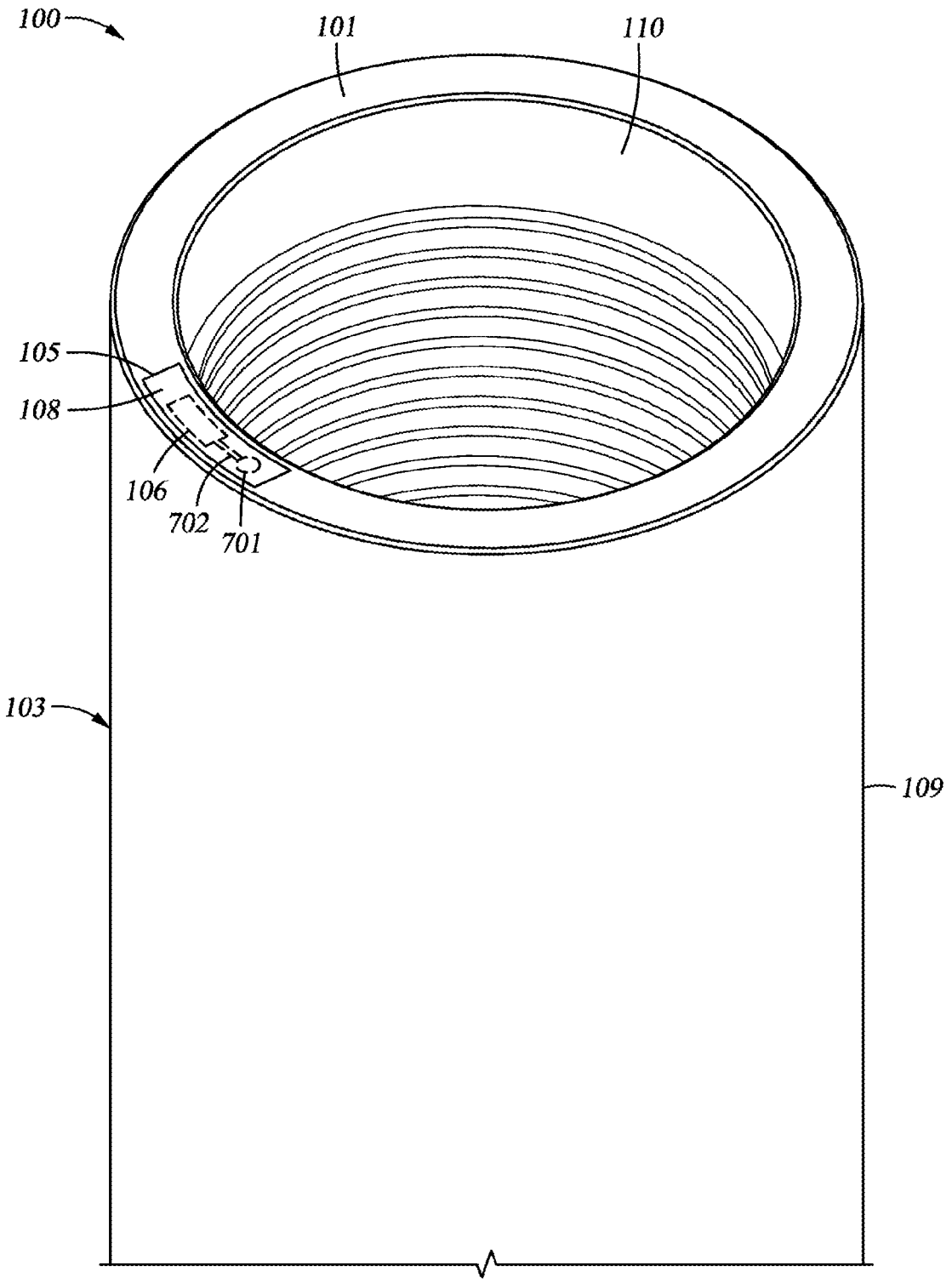
FIG. 14 is a perspective view of a box end of a downhole tool with an integrated circuit and a power supply in a primary mating surface.

Referring now to (PRIOR ART) FIG. 14, a downhole tool 100 may comprise a component 106 with active circuitry disposed within a recess 105 in a primary mating surface 101. Active circuitry requires a power source 701 in order to function properly. In addition to the component 106, the recess 105 may comprise such a power source 701 in electrical communication with the component 106 through a system of one or more electrical conductors 702. One type of usable power source 701 is a battery. Other aspects of the invention may be implemented for distributed power generation and/or storage, localized power delivery, charge, discharge, recharge capability to supply network and network-attached devices. The active circuitry may be, for example, active RFID circuitry capable of receiving interrogating signals and transmitting identification information at greater distances than are possible with purely passive circuitry. The component 106, power source 701, and electrical conductor(s) 702 may all be encapsulated in a protective material 108.

Figure 15:
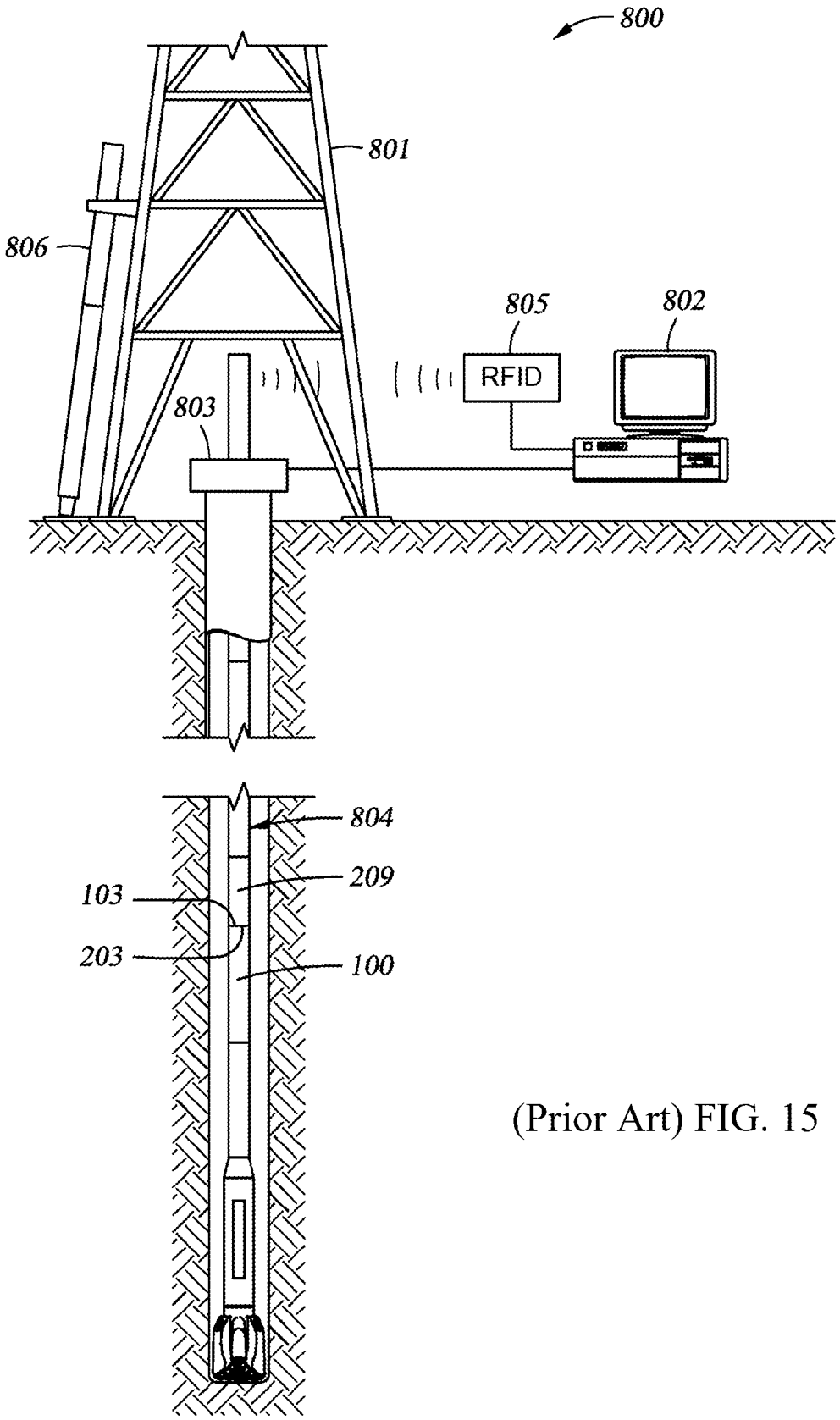
FIG. 15 depicts one embodiment of a downhole network.

Referring now to (PRIOR ART) FIG. 15, the present invention may be implemented in a downhole network 800. The downhole network 800 may comprise a tool string 804 suspended by a derrick 801. The tool string 804 may comprise a plurality of downhole tools 100, 209 of varying sizes connected by mating ends 103, 203. Each downhole tool 100, 209 may be in communication with the rest of the downhole network 800 through a system of inductive couplers or carriers.

One preferred system of inductive couplers, or carriers, for downhole data transmission is disclosed in U.S. Pat. No. 6,670,880 (assigned to the present assignee and incorporated by reference herein for all that it discloses). Other means of downhole data communication may be incorporated in the downhole network such as the systems disclosed in U.S. Pat. Nos. 6,688,396 and 6,641,434 to Floerke and Boyle, respectively; which are also herein incorporated by reference for all that they disclose.

A data swivel 803 located at the top of the tool string 804 may provide a communication interface between the rotating tool string 804 and stationary surface equipment 802. In this manner data may be transmitted from the surface equipment 802 through the data swivel 803 and throughout the tool string 804. Alternatively, a wireless communication interface may be used between the tool string 804 and the surface equipment 802. In the embodiment shown, an RFID transmitter/receiver apparatus 805 is located at the surface and may query RFID circuitry in downhole tools 100, 209 as they are added to or removed from the tool string 804. In this way, an accurate record of which specific tools make up the tool string 804 at any time may be maintained. Also, if a communications problem were traced to a specific downhole tool 100, 209 in the tool string 804, identification information received by the RFID transmitter/receiver apparatus 805 may be used in a database to access specific information about the faulty tool downhole 100, 209 and help resolve the problem. The RFID transmitter/receiver apparatus 805 may be in communication with the surface equipment 802 or may be an independent entity.

In other embodiments, the surface equipment 802 may not need the RFID transmitter/receiver 805 to communicate with the circuitry disposed within the downhole tools 100, 209. The surface equipment 802 may be equipped to send a query directly through wired downhole tools 100, 209 in the network 800 to RFID circuitry as will be discussed in more detail in the description of (PRIOR ART) FIG. 23. In other embodiments still, downhole tools 806 that are not connected to the network 800 may be queried by an RFID query device such as a wand (not shown) and relay identification information stored in a component 106 comprising RFID circuitry.

Figure 16:
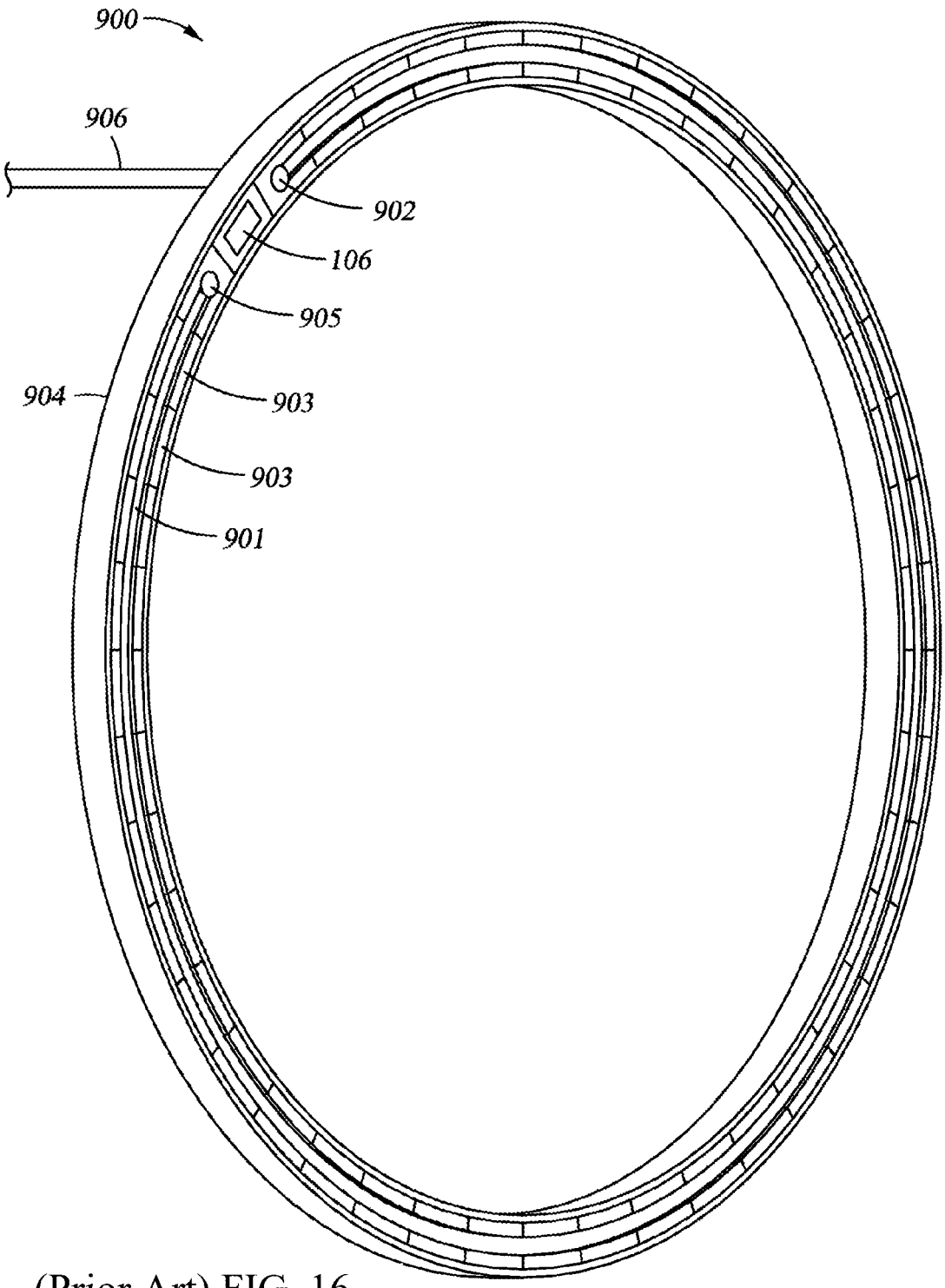
FIG. 16 is a perspective view of an inductive coupler and an integrated circuit consistent with the present invention.

Referring now to (PRIOR ART) FIG. 16, an inductive coupler 900 designed to be disposed in the recess, or groove, 105 of a downhole tool shoulder is depicted. In this embodiment the recess 105 is an annular groove designed to house both the inductive coupler 900 and the component 106 shown in (PRIOR ART) FIG. 17. The inductive coupler 900 is substantially similar to the inductive coupler disclosed in U.S. Pat. No. 6,670,880 with the addition of a component 106. The inductive coupler 900 comprises an electrically conducting coil 901 lying in a magnetically conductive electrically insulating trough 1101 see (PRIOR ART) FIG. 18. The electrically conducting coil 901 is shown as a single-turn coil of an electrically conducting material such as a metal wire; however, in other embodiments the electrically conducting coil 901 comprises multiple turns. The magnetically conductive electrically insulating trough may comprise a plurality of U-shaped fragments 903 arranged to form a trough around the electrically conducting coil 901. A preferred magnetically conductive electrically insulating material is ferrite, although several materials such as nickel or iron based compounds, mixtures, and alloys, mu-metals, molypermalloys, and metal powder suspended in an electrically-insulating material may also be used. A data signal may be transmitted from an electrical conductor 906 to a first point 902 of the electrically conducting coil 901 from which it flows through the electrically conducting coil 901 to a second point 905 which is preferably connected to ground.

When a first inductive coupler 900 is mated to a second similar inductive coupler 900, magnetic flux passes from the first magnetically conductive electrically insulating trough to the second magnetically conductive electrically insulating trough according to the data signal in the first electrically conducting coil 901 and induces a similar data signal in the second electrically conducting coil 901.

The inductive coupler 900 comprises a component 106. In one aspect wherein the component 106 includes an RFID circuit, the component may comprise an active RFID tag, a passive RFID tag, low-frequency RFID circuitry, high-frequency RFID circuitry, ultra-high frequency RFID circuitry, and combinations thereof. The component 106 may be located in a gap between the first point 902 and the second point 905 of the electrically conducting coil 901. The component 106, electrically conducting coil 901, and U-shaped fragments 903 may be encapsulated within a protective material 108 as disclosed in the description of (PRIOR ART) FIG. 12. The inductive coupler 900 may further comprise a housing 904 configured to fit into the recess 105 of the downhole tool shoulder.

The component 106 may be in electromagnetic communication with the electrically conducting coil 901 due to their close proximity to each other. In one aspect of the invention, the electrically conducting coil 901 may act as a very short-range radio antenna and transmit a signal that may be detected by RFID circuitry in the component 106. Likewise, an identification signal transmitted by RFID circuitry in the component 106 may be detected by the electrically conducting coil 901 and transmitted throughout a downhole network 800. In this manner, surface equipment 802 and other network devices may communicate with the component 106. Signals received from the component 106 in the electrically conducting coil 901 of the inductive coupler 900 may require amplification by repeaters (not shown) situated along the downhole network 800.

Figure 17:
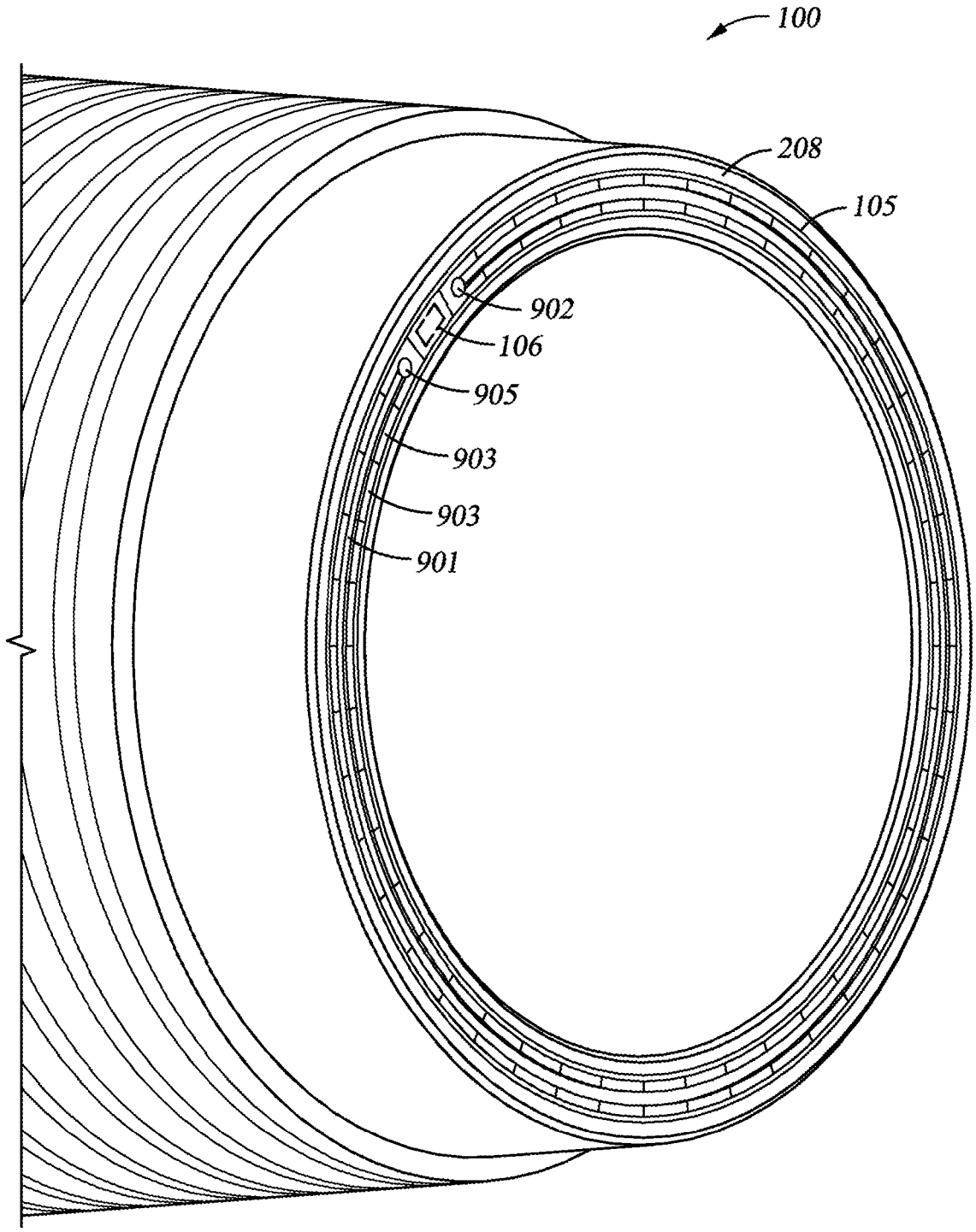
FIG. 17 is a perspective view of a pin end of a downhole tool with the inductive coupler and integrated circuit of (PRIOR ART) FIG. 16 disposed within a groove.

Referring now to (PRIOR ART) FIG. 17, a downhole tool 100 is shown with the inductive coupler 900 of (PRIOR ART) FIG. 16 disposed in a recess 105 of a secondary mating surface 208. In this embodiment, the recess 105 is an annular groove. The inductive coupler 900 may be configured to mate with a second inductive coupler in a secondary mating surface 601 of a box end 103.

Figure 18:
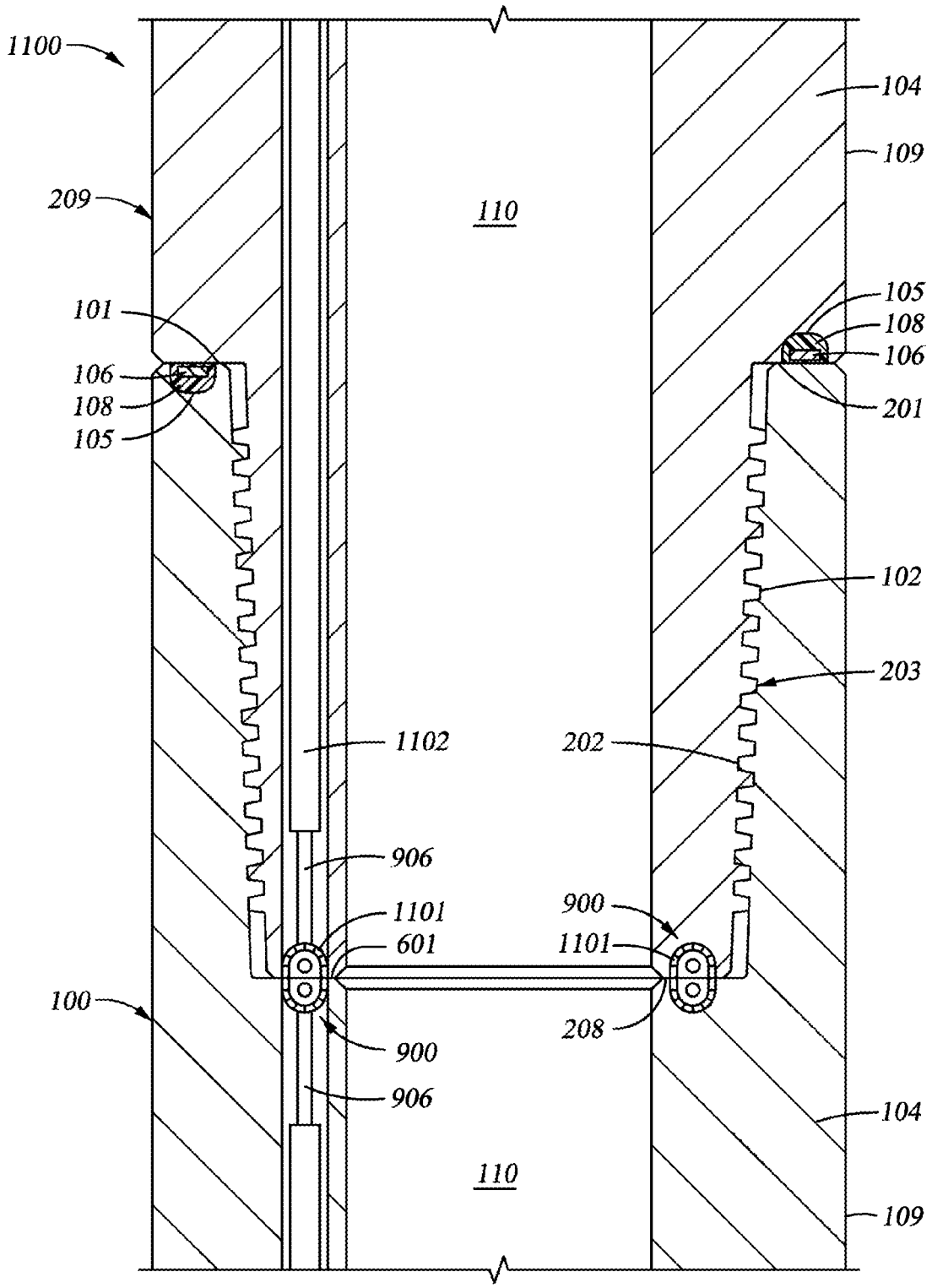
FIG. 18 is a cross-sectional view of a tool joint with inductive couplers in the secondary mating surfaces of the downhole tools and integrated circuits in the primary mating surfaces of the downhole tools.

Referring now to (PRIOR ART) FIG. 18, a cross-sectional view of a tool joint 1100 comprising the junction of a first downhole tool 100 and a second downhole tool 209 is shown. Each tool 100, 209 comprises both an inductive coupler 900 in a secondary mating surface 601, 208 and a component 106 disposed within the recess 105 of a primary mating surface 101, 201. Both inductive couplers 900 may be in close enough proximity to transfer data and/or power across the tool joint 1100. Both inductive couplers 900 may be lying in magnetically conductive, electrically insulating troughs 1101. Data or power signals may be transmitted from an inductive coupler 900 in one end of a downhole tool 100, 209 to an inductive coupler 900 in another end by means of the electrical conductor 906 in the inductive coupler 900. This electrical conductor 906 may be electrically connected to an inner conductor of a coaxial cable 1102. Mechanical seals created by the junction of primary mating surfaces 101, 201 and secondary mating surfaces 601, 208 may protect both the inductive couplers 900 and the components 106 from downhole conditions.

Figure 19:
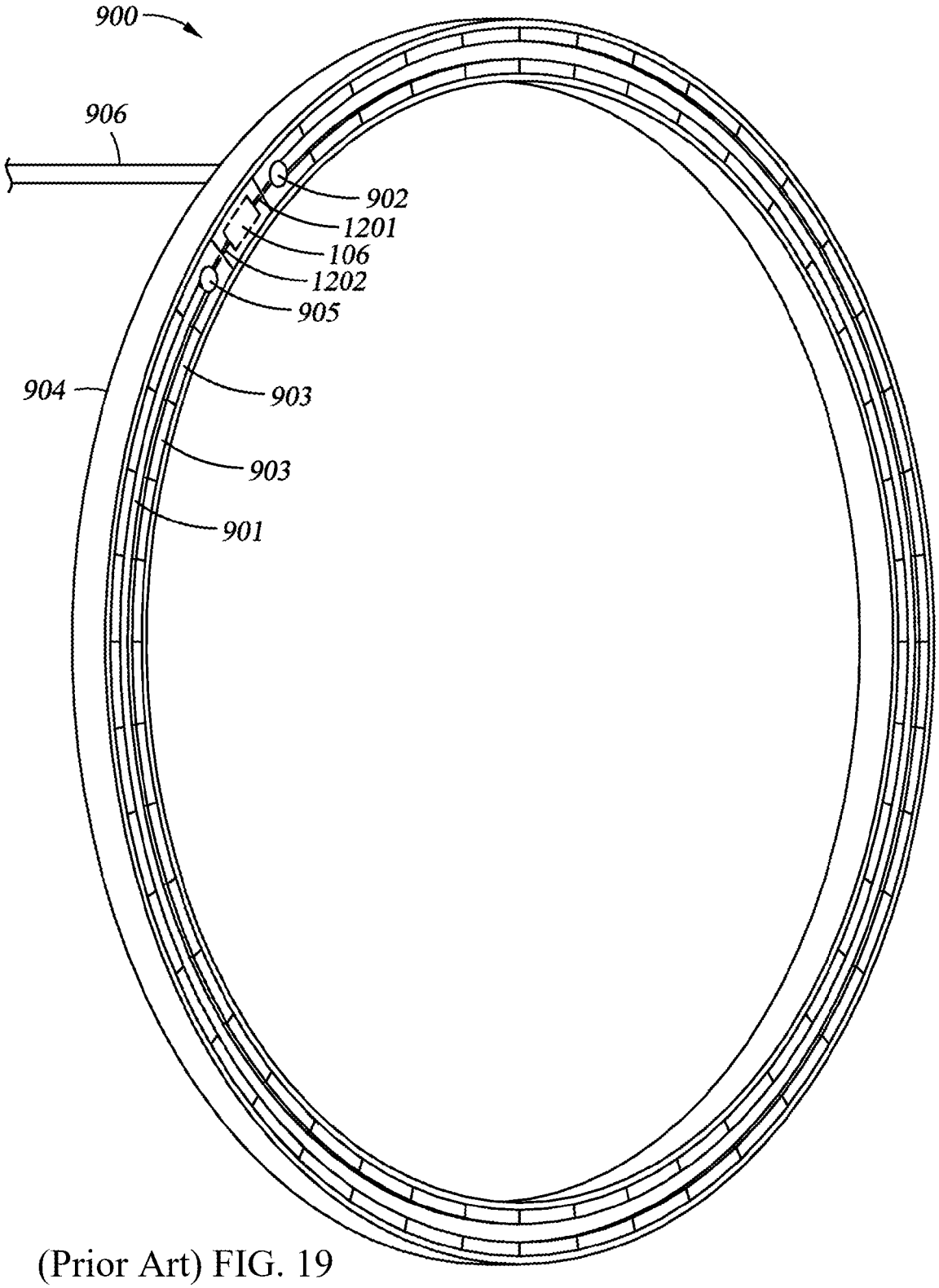
FIG. 19 is a perspective view of another embodiment of an inductive coupler and an integrated circuit consistent with the present invention.

Referring now to (PRIOR ART) FIG. 19, another embodiment of an inductive coupler 900 according to the invention may comprise a component 106 in direct electrical contact with the electrically conducting coil 901 through electrical conductor 1201. The component 106 may further be in electrical communication with ground through electrical conductor 1202. In one aspect, the component 106 may comprise passive RFID circuitry that requires a connection to an external antenna in order to receive and transmit RF signals. The electrically conducting coil 901 may function as that antenna. Through the downhole network 800, the RFID transmitter/receiver 805 of the surface equipment 802 may be in electromagnetic communication with the component 106.

Figure 20:
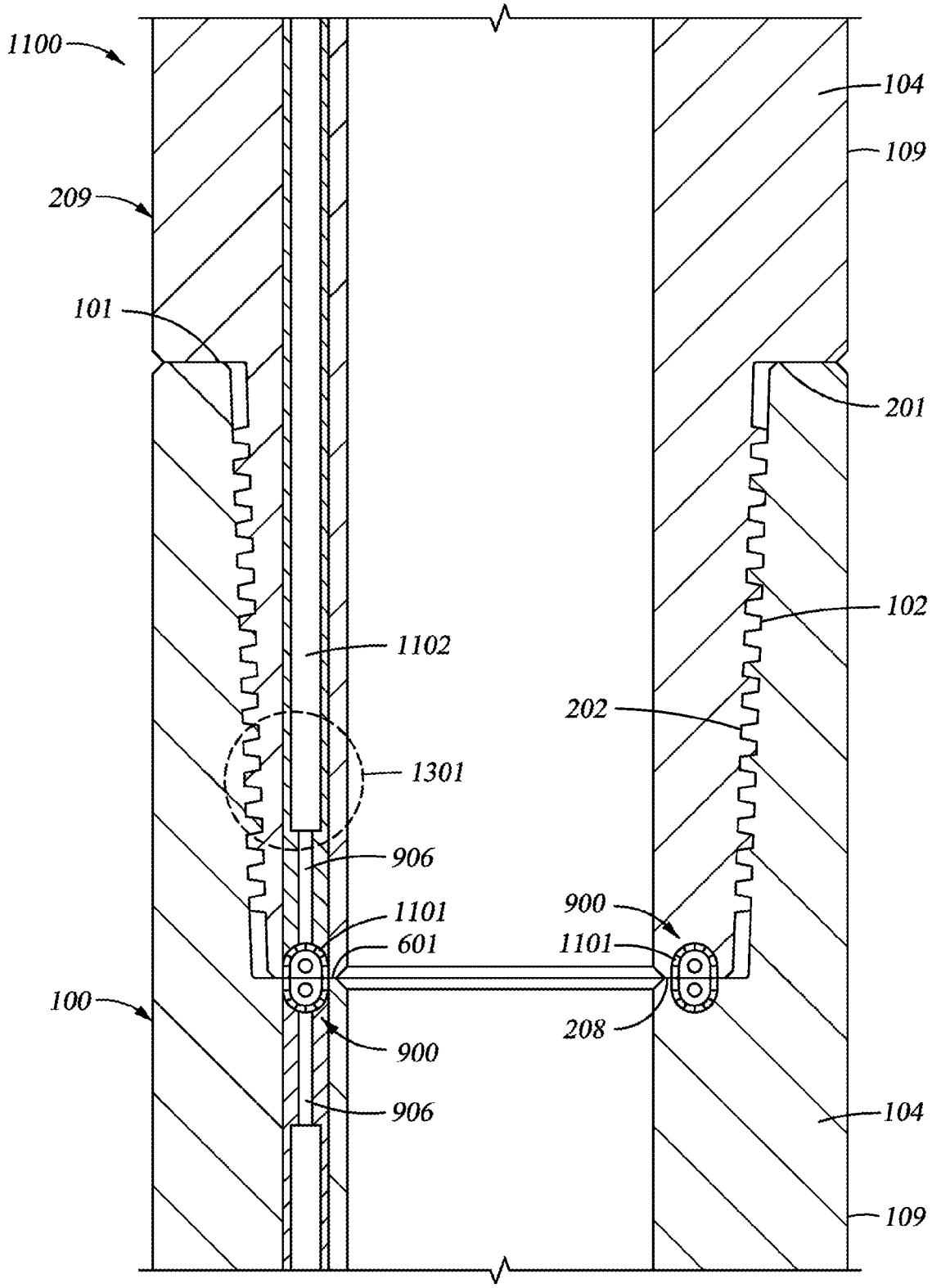
FIG. 20 is a cross-sectional view of tool joint with inductive couplers in the secondary mating surfaces of the downhole tools.

Referring now to FIGS. 20 and 21, a cross-sectional view of another embodiment of a tool joint 1100 is shown. Tools 100, 209 may be connected to the downhole network 800 through inductive couplers 900 and coaxial cable 1102. As is shown in (PRIOR ART) FIG. 15, the downhole network 800 may comprise surface equipment 802 comprising an RFID transmitter/receiver 805 configured with RFID interrogating circuitry.

Tool 209 may comprise a component (e.g., an integrated RFID circuit 1406). (PRIOR ART) FIG. 21 shows a detailed view 1301 of (PRIOR ART) FIG. 21. The coaxial cable 1102 may comprise an outer conductor 1401 and an inner conductor 1402 separated by a dielectric 1403. The inner conductor 1402 may be in electrical communication with the electrical conductor 906 of the inductive coupler 900 through connector 1404. The outer conductor 1401 may be in electrical communication with ground. In some embodiments, the outer conductor 1401 may also be in electrical communication with the tubular body 104 of the downhole tool 100 thus setting its potential at ground and providing access to a node with a ground potential for the inductive coupler 900.

Still referring to (PRIOR ART) FIG. 21, a protected RFID integrated circuit 1406 component is shown comprising a first electrical connection 1405 to electrical conductor 906 of the inductive coupler 900 See (PRIOR ART) FIG. 16 through connector 1404. Integrated circuit 1406 may also comprise a second electrical connection 1450 to ground through the outer conductor 1404. In other embodiments, the RFID integrated circuit 1406 component may be located between the coaxial cable 1102 and the inductive coupler 900. These locations may be particularly advantageous in providing a substantially protected environment from downhole operating conditions. In any location, the component 1406 may comprise connections 1405 to ground and inductive coupler 900. In this manner, the component 1406 may utilize the inductive coupler 900 as an external antenna see description of FIGS. 20, 22). Through the downhole network 800, the RFID transmitter/receiver 805 of the surface equipment 802 may be in electromagnetic communication with the component 1406.

In other embodiments of the invention, a direct electrical contact coupler or a hybrid inductive/electrical coupler such as is disclosed in U.S. Pat. No. 6,641,434 to Boyle, et al may be substituted for the inductive coupler 900. U.S. Pat. No. 6,929,493 (assigned to the present assignee and entirely incorporated herein by reference) also discloses a direct connect system compatible with the present invention.

Referring now to (PRIOR ART) FIG. 22, a method 1600 for identifying a downhole tool 100 in a tool string 804 is depicted. The method 1600 comprises the steps of transmitting 1610 an interrogating signal from surface equipment 802 to the downhole tool 100 and receiving 1620 the interrogating signal in identification circuitry disposed within a shoulder of the downhole tool 100. The interrogating signal may be an electromagnetic signal transmitted through a downhole network 800 and the identification circuitry may be a component 106 configured with suitable circuitry. The identification circuitry may further comprise RFID circuitry.

The RFID interrogation signals may be transmitted at first frequency while network data is transmitted at second frequency. In selected embodiments, a first series of RFIDs may respond to interrogation signals on a first frequency, while a second series of RFIDs may respond to interrogation signals on a second frequency. For example, it may be desirable to identify all of the downhole tools comprising network nodes. An interrogation signal may be sent on a frequency specific for those tools comprising network nodes and other RFIDs in communication with the downhole network will not respond.

The method 1600 further comprises the steps of transmitting 1630 an identification signal modulated with identification data from the identification circuitry to the surface equipment 802 and demodulating 1640 the identification data from the identification signal to identify the downhole tool 100. The identification data may be a serial number.

Referring now to (PRIOR ART) FIG. 23, a more detailed method 1700 for identifying a downhole tool 100 in a tool string 804 is illustrated. The method 1700 comprises the steps of surface equipment 802 producing 1705 an interrogating signal and the interrogating signal being transmitted 1710 through a downhole network 800. The interrogating signal may be an electromagnetic signal at a predetermined frequency and amplitude for a predetermined amount of time. The parameters of frequency, amplitude, and signal length may be predetermined according to characteristics of one or more components 106 in one or more downhole tools 100.

The downhole network 800 may comprise a downhole data transmission system such as that of the previously referenced '880 patent.

The method 1700 further comprises the downhole tool 100 receiving 1715 the interrogating signal from the downhole network 800 and transmitting 1720 the interrogating signal from an inductive coupler 900 to a component 106 in a shoulder of the downhole tool 100 comprising passive circuitry. In one aspect, the passive circuitry is preferably an integrated circuit that comprises RFID capabilities. The downhole tool 100 may receive 1715 the interrogating signal in the inductive coupler 900. The inductive coupler 900 may communicate wirelessly with the component 106 through an internal antenna in the passive circuitry. In other embodiments, the inductive coupler 900 may act as an external antenna for the component 106 and communicate with it through direct electrical communication. The component 106 may then transmit 1725 an identification signal to the inductive coupler 900 in the downhole tool 100. The identification signal may comprise identification information such as a serial number modulated on a sinusoidal electromagnetic signal.

The method further comprises the downhole tool 100 transmitting 1730 the identification signal to the surface equipment 802 through the downhole network 800. The surface equipment 802 may receive 1735 the identification signal from the downhole network 800 and demodulate 1740 the identification signal to retrieve the identification information and identify the downhole tool 100. The identification information on the identification signal may then permit the surface equipment 802 to access a database or other form of records to obtain information about the downhole tool 100.

Aspects of the invention also include platforms for holding and linking components 106 to a transmission line. Placement of components away from the mating junction or end point of a tool/tubular provides protection for the component and offers additional advantages such as greater manufacturing flexibility. (PRIOR ART) FIG. 24 shows an embodiment of a component 106 platform 1800 of the invention. In one aspect, the platform 1800 comprises a cylindrical-shaped unit having a cavity or recess 1802 formed therein. Platform 1800 aspects of the invention may be configured in any suitable shape and in various dimensions depending on the particular implementation. However, it will be appreciated by those skilled in the art that platform 1800 implementations for use with transmission lines disposed in small and confined conduits (e.g., the walls in a tubular) require substantial miniaturization of the assemblies. Platform 1800 aspects of the invention may be made of any suitable conductive material, insulating material, or combinations thereof. In the aspect shown in (PRIOR ART) FIG. 24, the platform 1800 is made of a suitable conductive material (e.g., metal). The platform 1800 includes voids or channels 1804 formed at each end of the unit. The platform 1800 may be manufactured using any techniques as known in the art, such as machining or die-cast processes.

A desired component 106 is mounted in the recess 1802, as shown in (PRIOR ART) FIG. 25. An insulating material is placed between the component 106 and the recess 1802 surface to form a non-conductive or insulating barrier 1806. Suitable conventional materials may be used to form the barrier 1806, including heat-shrink tubing, insulating compounds, non-conductive films, etc. The component 106 is mounted in the recess 1802 to form an electrical junction 1808 with the platform 1800. The electrical junction 1808 may be formed by any suitable means known in the art (e.g., any die attach method, wire bonding, wire leads, flex circuit, connectors, brazing, welding, press fit, electrical contact, solder, conductive adhesive, conductor leads, etc.). A linking element 1810 extends from an end of the component 106 to provide another connection point. The linking element 1810 can be affixed to the component 106 via any suitable means as known in the art (e.g., any die attach method, wire bonding, wire leads, flex circuit, connectors, brazing, welding, press fit, electrical contact, solder, conductive adhesive, conductor leads, etc.). In one aspect, the linking element 1810 consists of a flexible circuit with a conductive trace embedded therein. In some aspects, the linking element 1810 is part of a pre-formed component 106. In yet other aspects, the component 106 may be implemented with integral pins, or other types of contact points, configured to mesh with appropriate receptacles or contacts formed on the platform 1800 (e.g., microchip with connector pins) (not shown). When implemented with an active component 106, a power source 701 (e.g., battery) may be linked to the component via any suitable means known in the art. The aspect shown in (PRIOR ART) FIG. 25 comprises a power source 701 disposed in the recess 1802 along with the component 106.

(PRIOR ART) FIG. 26 shows the component platform 1800 coupled onto a transmission line 1812. In one aspect, the transmission line 1812 comprises conventional coaxial cable. The platforms 1800 of the invention can be implemented for use with transmission lines comprising various types of waveguides (e.g., fiber optics) and for operation at multiple frequencies. As used herein, the term "waveguide" includes any medium selected for its transmission properties of energy between two or more points along said medium. Aspects of the invention can be implemented for use with various types of energy guides and their combinations (i.e., 'hybrid' channels), such as a microwave cavity guide, microwave microstrips, optical channels, acoustic channels, hydraulic channels, pneumatic channels, thermally conductive channels, radiation-pas sing/blocking channels, mechanical activation channels, etc. For electromagnetic applications, transmission line aspects may include any impedance-controlled cable (e.g., triaxial cable, parallel wires, twisted-pair copper wire, etc.). The platform 1800 unit is interposed between two segments of the transmission line 1812 to link the component 106 onto the line. As shown, in the illustrated embodiment, an outer contour of the component 106 does not exceed an outer contour (e.g., an outer diameter) of the platform 1800. Similarly, an outer contour of the platform 1800 does not exceed an outer contour (e.g., an outer diameter) of the transmission line 1812. This will allow the platform 1800 and component 106 to be disposed in small and confined conduits sized to accommodate the transmission line 1812. For coaxial cable transmission lines 1812, the cable's center conductor 1814 is inserted into the channels 1804 at each end of the platform unit. With a conductive platform 1800, electrical coupling between the cable conductor 1814 and the component 106 is achieved at junction 1808. The insulating barrier 1806 isolates the component 106 body, including the linking element 1810, from the platform 1800.

A suitable material or sleeve 1816 may be disposed or wrapped over the platform body to cover the recess 1802 and sheath the component 106, leaving an end of the linking element 1810 exposed. A non-conductive cap or sleeve 1818 is placed on the end of the platform to provide additional isolation between the exposed linking element 1810 and the unit body. Any suitable materials may be used to form the insulating barriers and sheaths on the platform 1800, including those used to implement the protective material 108 described above. The sleeve 1818 end of the platform 1800 is coupled with the transmission line 1812 such that the line's conductor 1814 engages with the channel 1804 to form a conductive junction with the platform unit.

The exposed end of the linking element 1810 is linked to another conductor/plane on the transmission line 1812 to complete the circuit with the component 106 in the line. In the case of a coaxial cable transmission line 1812, the linking element 1810 is routed to make contact with the grounding conduit 1815 around the coax. The entire platform 1800 unit and adjoining transmission line segments are then covered with a non-conductive material 1820 to seal and protect the assembly. The protective material 1820 may be disposed over the transmission line in any suitable manner. In some aspects, the protective material 1820 consists of a non-conductive sleeve disposed on the transmission line 1812 prior to insertion of the platform 1800 onto the line, whereupon the sleeve is slid over the mounted assembly. Other aspects can be implemented with a protective material 1820 wrapped around the platform assembly, or with a suitable sealing compound applied and cured on the transmission line as known in the art. In yet other aspects, additional strengthening/protection for the platform 1800 assembly may be provided as known in the art (e.g., covering the line/assembly with armored sheathing) (not shown).

(PRIOR ART) FIG. 27 shows another component platform 1800 of the invention. In this aspect, an annular or donut-shaped conductor 1824 is mounted on the platform 1800 body in direct contact with the linking element 1810. The element 1810 can be securely affixed to the conductor 1824 if desired (e.g., soldering, conductive adhesive, etc.). A suitable insulating material 1826 (e.g., heat shrink) is disposed between the conductor 1824 and the platform 1800 body to isolate the conductor. In some aspects, the component insulation barrier 1806 see (PRIOR ART) FIG. 25 extends along the platform body to provide the desired conductor 1824 isolation. In other aspects, a circumferential groove or channel 1823 can be formed on the platform 1800 to accept and hold the conductor 1824 at a set position on the unit body. The conductor 1824 is preferably a one-piece element (e.g., a coiled radial spring) freely disposed on the platform 1800 to allow for movement thereon, providing greater contact reliability with a conductor on the transmission line 1812 (e.g., the grounding conduit around a coax cable).

(PRIOR ART) FIG. 28 shows an overhead view of another component platform 1800 of the invention. In this aspect an insulating sheath 1830 is disposed on the platform 1800 to cover the component 106. The sheath 1830 is configured with an opening 1832 to allow passage of a linking element 1810 from the component 106. In one aspect, the linking element 1810 is a flexible printed circuit configured with conductive traces to establish electrical contact to form the circuit. One end of the element 1810 makes contact (e.g., via solder, conductive adhesive, etc.) with the platform 1800 body, and the other end extends through the sheath opening 1832 for connection to a conductor on the transmission line 1812, or to an intermediate conductor 1824 as described with respect to (PRIOR ART) FIG. 27. In one aspect, a nonconductive annular or ring clip 1834 with walls forming a circumferential channel may be placed on the platform 1800 to hold and support the conductor 1824. The clip 1834 can be free-floating or securely mounted on the platform.

(PRIOR ART) FIG. 29 shows another component platform 1800 of the invention. In this aspect, the platform comprises a multi-piece assembly. A midbody unit 2000 is configured with a cavity or recess 2002 to accept and hold a component 106. In one aspect, the midbody unit 2000 is formed using a non-conductive material (e.g., plastic, composite, etc.). The midbody unit 2000 is configured with ends that couple with end connectors 2004 to form an assembly. With an insulating midbody unit 2000, the end connectors 2004 are formed using a conductive material such as metal. (PRIOR ART) FIG. 30 shows the assembled platform 1800. The desired component(s) 106 can be disposed in the recess 2002 and linked to a transmission line as described herein.

(PRIOR ART) FIG. 31 shows a side cut-away view of another component platform 1800 of the invention. In this aspect, a platform 1800 is mounted onto the transmission line 1812 without breaking (i.e., severing) the line. In the case of a coaxial cable transmission line 1812, the component 106 is designed to clip onto the center conductor 1814. Conventional materials and techniques may be used to implement the desired components 106 (e.g., flex circuits, microchip technologies, etc.). A spring conductor 2408 is then placed in contact with the component 106 to complete the circuit with the ground plane 1840 on the cable 1812. If desired, any voids left in the cable can be filled with a suitable material. Once mounted onto the line 1812, the platform 1800 assembly can be covered/sealed in place as desired.

Aspects of the invention provide the ability to control, generate, and manipulate signal features on a transmission line in various ways. As previously discussed, components 106 configured with RFID circuitry can be disposed on a platform 1800 to provide certain features. The platforms 1800 may also be used to create conditional signal paths along a transmission line. For example, (PRIOR ART) FIG. 26 shows a platform 1800 configured to mount a component 106 in electrical parallel along the transmission line. (PRIOR ART) FIG. 30 shows a platform 1800 configured to mount a component 106 in series along the transmission line. The implementation of platforms 1800 with appropriate circuit topology allows one to affect signals on a transmission line in any desired way. (PRIOR ART) FIG. 32 shows several circuit topologies that can be implemented with aspects of the invention to affect a signal on a transmission line.

(PRIOR ART) FIG. 32(A) shows a topology that may be used to configure a component 106 in parallel along the transmission line. As shown, the component 106 is connected across the center conductor 1814 and the ground conductor 1840. (PRIOR ART) FIG. 32(B) shows a topology that may be used to configure a component 106 in series with the transmission line 1814. As shown, the component 106 is placed in line with the center conductor 1814.

Signal activation/control on the transmission line can also be achieved with components 106 configured to change state upon selective activation. Components 106 configured with conventional microchip technology can be mounted on the platforms 1800 to condition signals, signal paths, and/or generate signals on the line. For example, aspects of the invention can be implemented to selectively create a full or partial short to a ground plane on a transmission line (not shown). Other aspects can be implemented to selectively create a series open-circuit on the line (not shown). Such signal manipulation can be achieved by platform 1800 aspects configured with components 106 and circuit topologies as disclosed herein.

(PRIOR ART) FIG. 33 shows two tubulars 209, 100 configured with component platforms 1800 of the invention. The pin-end tubular 209 comprises an inductive coupler 900 disposed thereon as disclosed herein. An electrical conductor 906 extends from the coupler 900, through the tubular wall, to couple into one end of the platform 1800 as disclosed herein. The other end of the platform 1800 is coupled to a transmission line 1812 (e.g., coaxial cable) routed through the tubular 209. In this particular aspect, the platform 1800 is disposed within a channel or conduit 2600 formed in the tubular wall. Such placement of the platform 1800 provides additional protection to the component(s) mounted on the platform. Other aspects may be implemented with a platform 1800 linked to the transmission line 1812 at points where the line is exposed inside the tubular bore or along the tubular exterior. As previously described, in some aspects the coupler 900 may be used as an external antenna for an RFID circuit disposed on the component 106 on the platform 1800. The box-end tubular 100 also comprises an inductive coupler 900 disposed thereon as disclosed herein. In this particular aspect, the platform 1800 is linked onto the transmission line 1812 at a point where the line is exposed inside the tubular bore.

(PRIOR ART) FIG. 34 depicts a flowchart of a method 3000 according to an aspect of the invention. A process for linking a component 106 to a transmission line 1812 entails coupling a platform 1800 unit onto the line at a non-end point along the line to link the component to the line, at step 3005. The unit is configured to accept and hold a component 106, as described herein. At step 3010, the transmission line is linked to a downhole network 800. At step 3015 a signal is affected on the transmission line via the component. As disclosed herein, a signal may be affected 'on' a transmission line when a signal conveyed along the transmission line is affected (including no effect at all), when a signal is generated on the transmission line, when a signal is transmitted from the transmission line, when a signal is received/detected on the transmission line, and/or when a signal path on the transmission line is affected.

(PRIOR ART) FIG. 35 depicts a flowchart of a method 4000 according to an aspect of the invention. A process for linking a component 106 to a transmission line 1812 entails coupling a platform 1800 unit onto the line at a non-end point along the line, at step 4005. The unit is configured to accept and electromagnetically link a component to the line, as described herein. At step 4010, the transmission line is disposed on a tubular 100, 209 to provide a signal path along a longitudinal axis of the tubular for communication with a downhole network 800.

Advantages provided by the disclosed techniques include, without limitation, the ability to use a very small format to make isolated component 106 connections to a downhole network 800. The platforms 1800 also allow for introduction and/or removal of hardware along a transmission line without the loss of desired signal/identification features of individual transmission lines 1812 or segments making up the transmission line. For example, a downhole tubular 100, 209 equipped with a transmission line incorporating a platform 1800 allows one to replace a coupler coil 900 on the tubular without losing any identification/parameter data (e.g., RFID signals) contained in a component 106 disposed on the platform. With aspects implemented with an addressable component 106, one can remotely command it to 'activate' and if it does not, then it is not visible to the network 800. Breaks in the network can be identified and isolated in this manner, among other uses.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in networks 800 combining multiple signal conveyance formats (e.g., mud pulse, fiber-optics, etc.). The disclosed techniques are not limited to subsurface operations. Aspects of the invention are also suitable for network 800 signal manipulation conducted at, or from, surface. For example, a component platform 1800 of the invention can be disposed on, or linked to, equipment or hardware located at surface (e.g., the swivel 803 in (PRIOR ART) FIG. 15) and linked to the downhole network 800. It will be appreciated by those skilled in the art that the component platforms 1800 of the invention may be implemented for use with any type of tool/tubular/system wherein a transmission line is used for signal/data/power conveyance (e.g., casing, coiled tubing, etc.). It will also be appreciated by those skilled in the art that the signal manipulation techniques disclosed herein can be implemented for selective operator activation and/or automated/autonomous operation via software configured into the downhole network (e.g., at surface, downhole, in combination, and/or remotely via wireless links tied to the network). All such similar variations apparent to those skilled in the art are deemed to be within the scope of the invention as defined by the appended claims.

The invention claimed is:

1. A tool string composite transmission element, comprising:

an annular polymeric carrier comprising an electrical conductor embedded therein, comprising between 20 and 353 individual fragments strung together on the electrical conductor;

the electrical conductor suitable for producing an electromagnetic field within the annular polymeric carrier when electrically energized, and wherein the annular polymeric carrier comprises a volume of magnetically conductive electrically insulating (MCED) particles sufficient to allow the annular polymeric carrier to transmit the electromagnet field to an adjacent similarly constructed annular polymeric carrier.

2. The tool string composite transmission element of claim 1, wherein the annular polymeric carrier comprises an annular configuration.

3. The tool string composite transmission element of claim 1, wherein the annular polymeric carrier comprises a linear configuration.

4. The tool string composite transmission element of claim 1, wherein the electrical conductor is a wire.

5. The tool string composite transmission element of claim 1, wherein the electrical conductor comprises an anti-rotation tab.

6. The tool string composite transmission element of claim 1, wherein the annular polymeric carrier comprises an anti-rotation slot that mates with the anti-rotation tab.

7. The tool string composite transmission element of claim 1, wherein the volume of MCEI particles comprises around between 65 and 84 percent by volume of the annular polymeric carrier.

8. The tool string composite transmission element of claim 1, wherein the volume of MCEI particles comprises around between 85 and 90 percent by volume of the annular polymeric carrier.

9. The tool string composite transmission element of claim 1, wherein the volume of MCEI particles comprises around up to 97 percent by volume of the annular polymeric carrier.

10. The tool string composite transmission element of claim 1, wherein the annular polymeric carrier exhibits in cross section an arcuate outer wall joining a planar top surface and an electrical conductor disposed below the top surface.

11. The tool string composite transmission element of claim 1, wherein the annular polymeric carrier exhibits in cross section an arcuate outer wall joining a partially planar top surface and an electrical conductor disposed below the top surface, wherein the partially planar top surface is interrupted by a depression disposed above the electrical conductor.

12. The tool string composite transmission element of claim 1, wherein the electrical conductor comprises a ground end attachable to the tool string and a transmission end attachable to a cable within the tool string.

13. The tool string composite transmission element of claim 1, wherein the annular polymeric carrier comprises a bumper.

14. The tool string composite transmission element of claim 1, wherein the annular polymeric carrier comprises a generally U-shape cross section.

15. The tool string composite transmission element of claim 1, wherein the annular polymeric carrier comprises one or more perforations.

16. The tool string composite transmission element of claim 1, wherein the annular polymeric carrier comprises a void proximate the bumper.

17. The tool string composite transmission element of claim 1, wherein the annular polymeric carrier comprises a plurality of fragments.

18. The tool string composite transmission element of claim 1, wherein the annular polymeric carrier is disposed within a groove within a tool within the tool string.

19. The tool string composite transmission element of claim 18, wherein the groove comprises a region harder than the surrounding tool.

* * * * *